US009513575B2

(12) United States Patent
Kimura et al.

(10) Patent No.: US 9,513,575 B2
(45) Date of Patent: Dec. 6, 2016

(54) REMOVABLE DEVICE AND IMAGE FORMING APPARATUS

(71) Applicants: Hideki Kimura, Kanagawa (JP); Masaki Takahashi, Kanagawa (JP); Toshiki Hayashi, Kanagawa (JP); Masayuki Yamane, Kanagawa (JP)

(72) Inventors: Hideki Kimura, Kanagawa (JP); Masaki Takahashi, Kanagawa (JP); Toshiki Hayashi, Kanagawa (JP); Masayuki Yamane, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/338,472

(22) Filed: Jul. 23, 2014

(65) Prior Publication Data

US 2015/0037050 A1 Feb. 5, 2015

(30) Foreign Application Priority Data

Jul. 31, 2013 (JP) ..... 2013-159366
Oct. 18, 2013 (JP) ..... 2013-217734

(51) Int. Cl.
*G03G 15/08* (2006.01)
*G03G 21/18* (2006.01)

(52) U.S. Cl.
CPC ..... *G03G 15/0863* (2013.01); *G03G 21/1885* (2013.01)

(58) Field of Classification Search
CPC ..... G03G 15/0863; G03G 21/1885
See application file for complete search history.

(56) References Cited

U.S. PATENT DOCUMENTS

| | | | | |
|---|---|---|---|---|
| 6,148,354 | A * | 11/2000 | Ban et al. | 710/301 |
| 6,253,035 | B1 * | 6/2001 | Kawana et al. | 399/24 |
| 2001/0014225 | A1 * | 8/2001 | Otsubo et al. | 399/24 |
| 2002/0114646 | A1 | 8/2002 | Sudo et al. | |
| 2003/0170042 | A1 * | 9/2003 | Okamoto et al. | 399/90 |
| 2004/0163843 | A1 * | 8/2004 | Shin et al. | 174/254 |
| 2005/0019061 | A1 * | 1/2005 | Karakama et al. | 399/111 |

(Continued)

FOREIGN PATENT DOCUMENTS

JP 2012-226288 11/2012

*Primary Examiner* — David Gray
*Assistant Examiner* — Sevan A Aydin
(74) *Attorney, Agent, or Firm* — Oblon, McClelland, Maier & Neustadt, L.L.P.

(57) ABSTRACT

A removable device is removably attachable to an image forming apparatus main body. The removable device includes an information storage device, a holder, and a low frictional structure. The information storage device includes: an information storage unit that stores information to be communicated between the apparatus main body and the removable device; a terminal to be contacted with an apparatus main-body terminal, for communicating information with the apparatus main body; and a substrate that holds the information storage unit and the terminal and that includes a guide to be fitted to a protrusion provided on the apparatus main body. The holder holds the substrate such that the substrate can move, when the removable device approaches the apparatus main-body terminal, on a virtual plane intersecting with a moving direction of the removable device. The low frictional structure is arranged on a contact area between the substrate and the holder.

16 Claims, 20 Drawing Sheets

(56) References Cited

U.S. PATENT DOCUMENTS

| | | | | |
|---|---|---|---|---|
| 2005/0226655 | A1 | 10/2005 | Katsuyama et al. | |
| 2006/0083555 | A1 | 4/2006 | Uchiyama et al. | |
| 2007/0147902 | A1 | 6/2007 | Taguchi et al. | |
| 2007/0177177 | A1* | 8/2007 | Murakami | 358/1.13 |
| 2010/0226690 | A1 | 9/2010 | Kadota et al. | |
| 2012/0200871 | A1 | 8/2012 | Takahashi et al. | |
| 2013/0251971 | A1* | 9/2013 | Kataoka | C09J 7/0285 428/220 |
| 2013/0307906 | A1* | 11/2013 | Ishizawa et al. | 347/50 |
| 2014/0314443 | A1 | 10/2014 | Takahashi et al. | |

* cited by examiner

REMOVABLE DEVICE AND IMAGE FORMING APPARATUS

CROSS-REFERENCE TO RELATED APPLICATION(S)

The present application claims priority to and incorporates by reference the entire contents of Japanese Patent Application No. 2013-159366 filed in Japan on Jul. 31, 2013 and Japanese Patent Application No. 2013-217734 filed in Japan on Oct. 18, 2013.

BACKGROUND OF THE INVENTION

1. Field of the Invention

The present invention relates to an image forming apparatus, such as a copier, a printer, a facsimile machine, or a multifunction peripheral, and a removable device that is removably installed in the image forming apparatus.

2. Description of the Related Art

Conventionally, in image forming apparatuses, such as copiers, a technique of removably installing removable devices, such as developer containers (toner bottles, toner containers, or ink cartridges) or process cartridges, in image forming apparatus main bodies has been widely used. A removable device is provided with an information storage device (an information recording unit or a non-volatile memory), such as an ID chip, that stores therein information to be exchanged with an image forming apparatus main body. Information stored in the information storage device is transmitted to a control unit of the image forming apparatus main body while the removable device is set in the image forming apparatus main body. Further, by transmission or the like of information from the image forming apparatus main body to the information storage device, adequate quality control is performed on the image forming apparatus main body and the removable device.

The information stored in the information storage device includes, for example, manufacturing year, month, and date of the removable device, a manufacturing lot number, a color of toner, or a type of toner. The information transmitted from the image forming apparatus main body to the information storage device includes a use history or the like of the image forming apparatus.

Japanese Patent No. 4886084 discloses a removable device including: an information storage device that includes an information storage unit that stores therein information communicated between an image forming apparatus main body and the removable device, includes a terminal that comes in contact with an apparatus main-body terminal installed in the image forming apparatus main body and communicates the information with an image forming apparatus main body, and includes a substrate that holds the information storage unit and the terminal and has a guide to be fitted to an apparatus main-body protrusion provided in the image forming apparatus main body; and a holder that holds the substrate of the information storage device such that the substrate, when the removable device approaches the apparatus main-body terminal provided in the image forming apparatus main body, is able to move on a virtual plane intersecting with a moving direction of the removable device.

In Japanese Patent No. 4886084, the substrate of the information storage device is held by the holder of the removable device such that the substrate can move on the virtual plane intersecting with the moving direction. Therefore, when the removable device is to be attached to the image forming apparatus main body, the guide of the substrate moves by being guided by the apparatus main-body protrusion. However, in this case, the substrate moves by being pushed against the holder; therefore, if slidability between the substrate and the holder is low, the apparatus main-body protrusion and the guide of the substrate may be caught together. Reduction in the slidability is caused by low surface property of the holder or by burr catching an edge of the substrate. As described above, if the apparatus main-body protrusion and the guide of the substrate are caught together or if the removable device is not accurately inserted in the image forming apparatus main body, the apparatus main-body terminal may not reach the substrate, resulting in a communication failure.

There is a need for a removable device and an image forming apparatus that prevent the apparatus main-body protrusion and the guide of the substrate from being caught together and that enable reliable attachment to a normal position to prevent a communication failure.

SUMMARY OF THE INVENTION

According to an embodiment, a removable device is removably attachable to an image forming apparatus main body. The removable device includes an information storage device, a holder, and a low frictional structure. The information storage device includes: an information storage unit that stores therein information to be communicated between the image forming apparatus main body and the removable device; a terminal to be contacted with an apparatus main-body terminal provided on the image forming apparatus main body, for communicating information with the image forming apparatus main body; and a substrate that holds the information storage unit and the terminal and that includes a guide to be fitted to a protrusion provided on the image forming apparatus main body. The holder holds the substrate of the information storage device such that the substrate is able to move, when the removable device approaches the apparatus main-body terminal provided on the image forming apparatus main body, on a virtual plane intersecting with a moving direction of the removable device. The low frictional structure is arranged on a contact area between the substrate and the holder.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
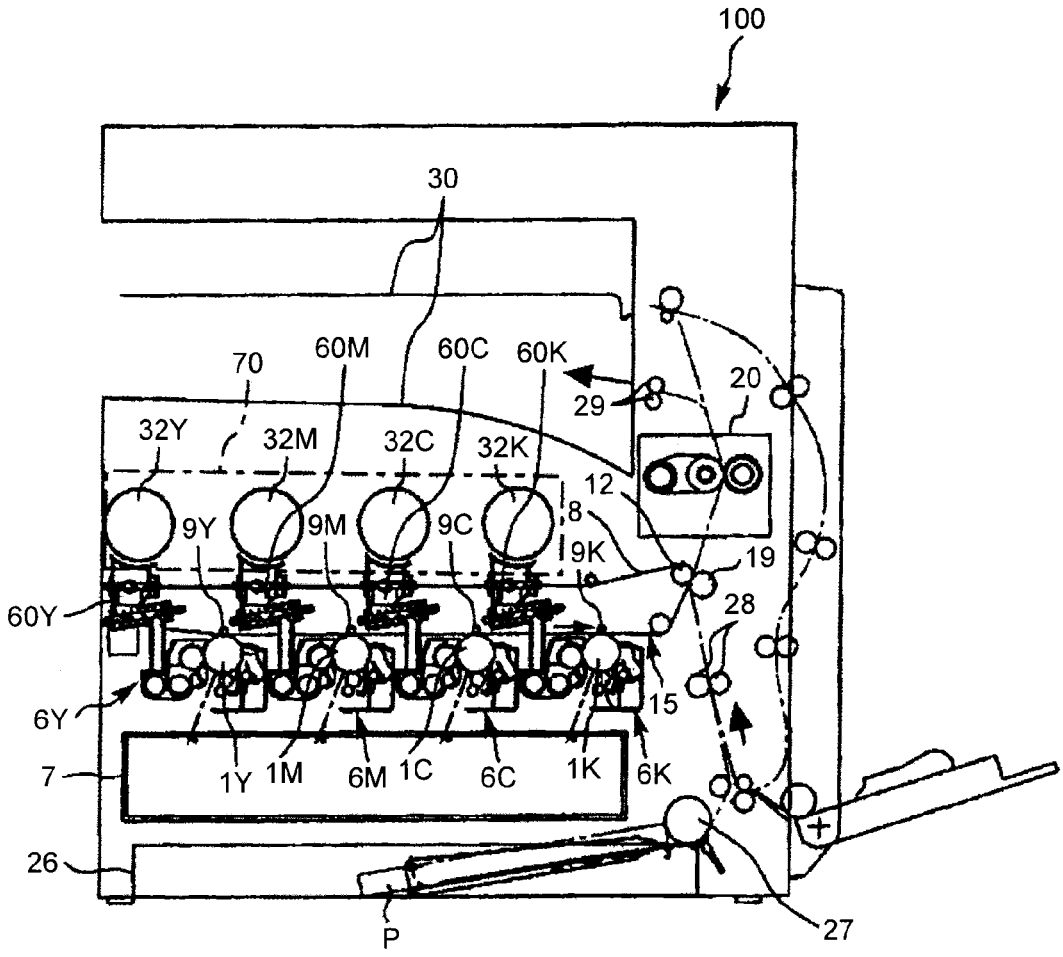
FIG. 1 is an overall configuration diagram illustrating an image forming apparatus according to a first embodiment of the present invention.

Hereinafter, embodiments for carrying out the present invention will be described in detail below with reference to the drawings. In the drawings, the same or corresponding parts are denoted by the same reference signs, and explanation thereof will be appropriately simplified or omitted.

First, an overall configuration and operations of an image forming apparatus will be described.

An image forming apparatus illustrated in FIG. 1 is a copier capable of forming full-color images by using yellow, magenta, cyan, and black developers. In a toner container holder 70 arranged in the upper side in an image forming apparatus main body 100, toner containers 32Y, 32M, 32C, and 32K serving as four removable devices corresponding to yellow, magenta, cyan, and black are removably (replaceably) installed.

An intermediate transfer unit 15 is arranged below the toner container holder 70. Image forming units 6Y, 6M, 6C, and 6K corresponding to the respective colors (yellow, magenta, cyan, and black) are arranged side by side so as to face an intermediate transfer belt 8 included in the intermediate transfer unit 15. Toner replenishing devices 60Y, 60M, 60C, and 60K are arranged below the toner containers 32Y, 32M, 32C, and 32K serving as the removable devices, respectively. Toners serving as developers accommodated in the toner containers 32Y, 32M, 32C, and 32K are supplied (replenished) to the inside of developing devices of the image forming units 6Y, 6M, 6C, and 6K by the toner replenishing devices 60Y, 60M, 60C, and 60K, respectively.

First Embodiment

An ID chip 35 that is characteristic in the toner container 32Y serving as the removable device according to the first embodiment will be described in detail below.

Figure 2:
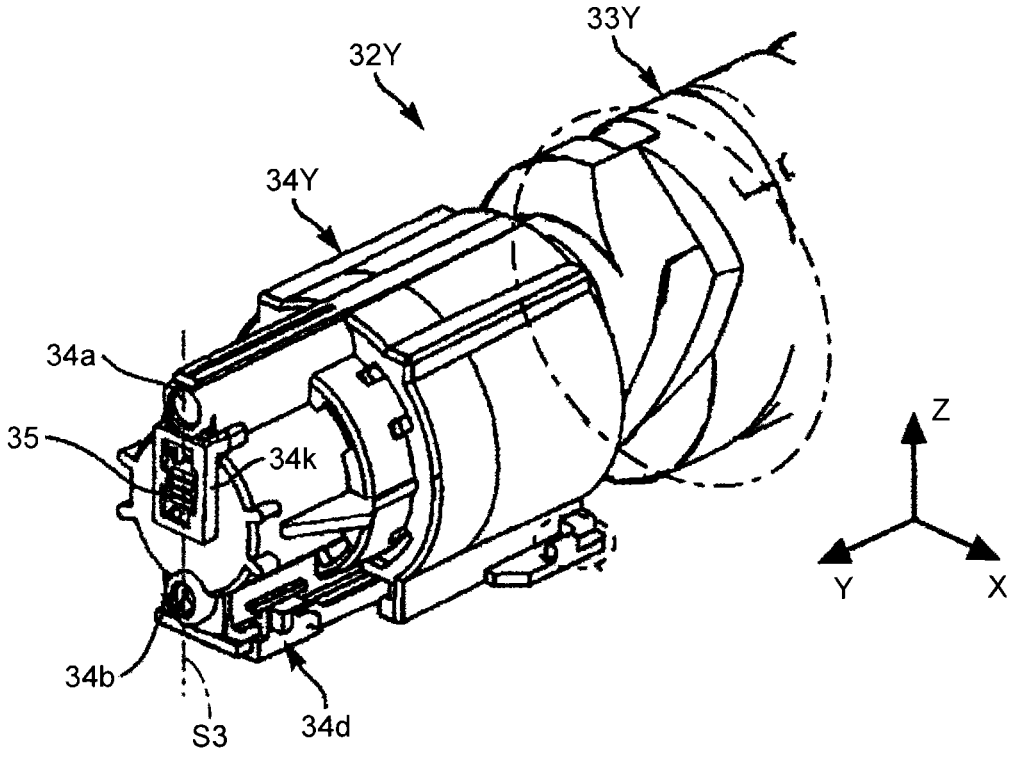
FIG. 2 is a perspective view illustrating a toner container on a cap side as viewed from obliquely above.
Figure 3:
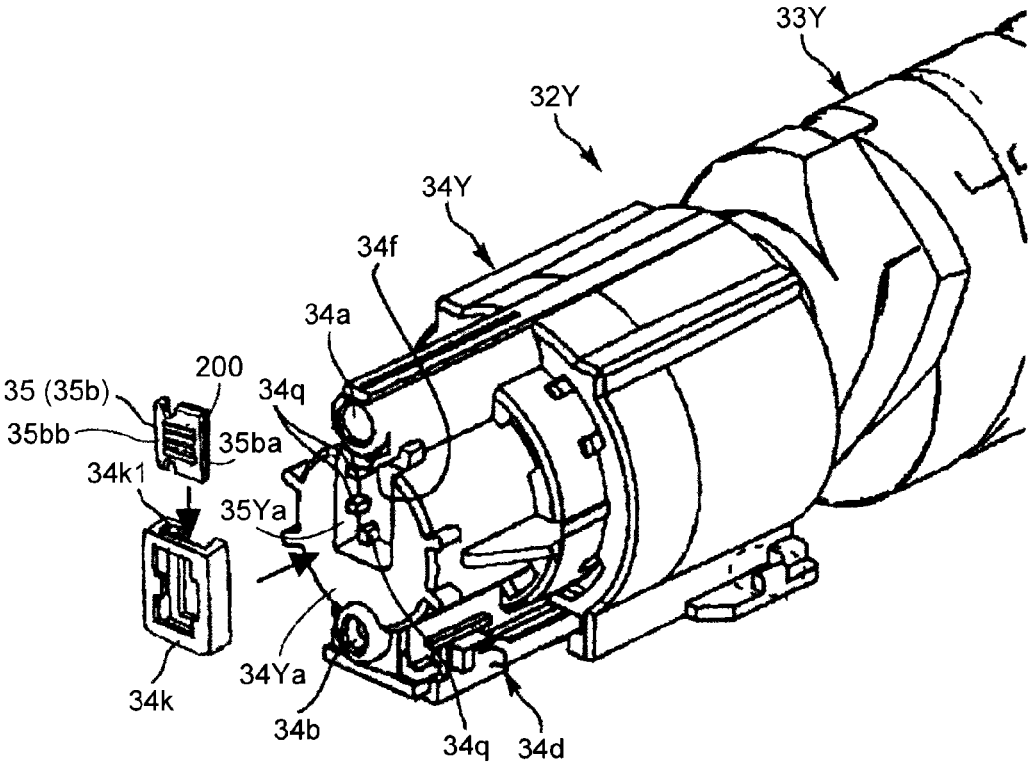
FIG. 3 is a perspective view illustrating a cap in a state in which an information storage device is removed.
Figure 4:
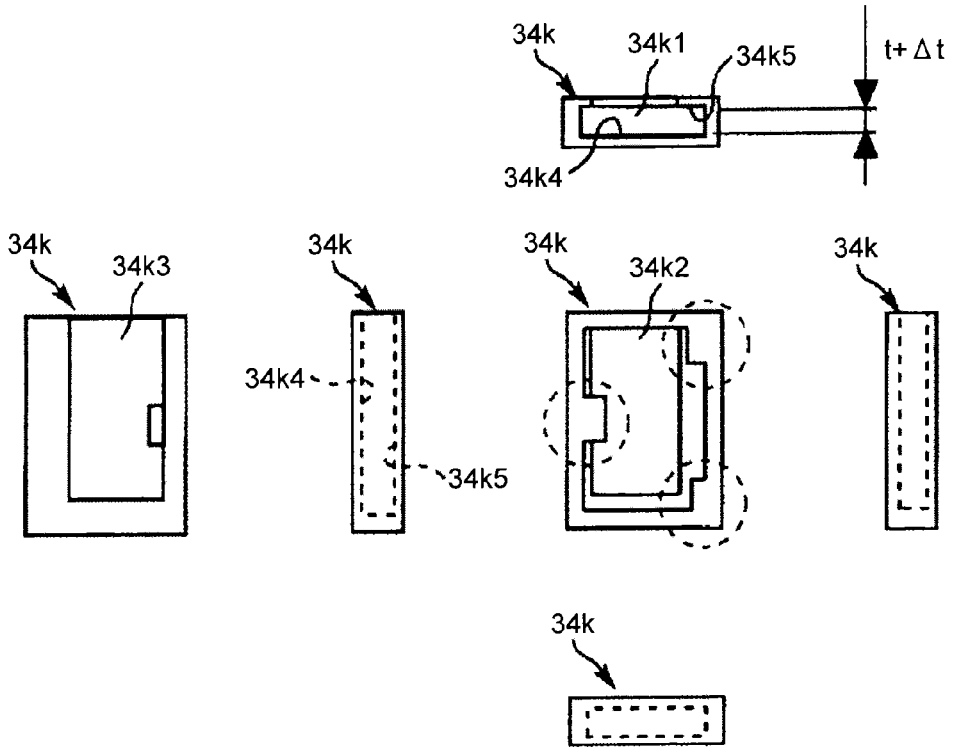
FIG. 4 is a six-plane view illustrating a holding portion of the information storage device.

Referring to FIG. 2, FIG. 3, or the like, on an end surface of a cap 34Y, the ID chip 35 storing various pieces of electronic information is installed in a position of a holding portion 34*k* forming a holder that is installed between a first positioning hole 34*a* and a second positioning hole 34*b*. The ID chip 35 is configured to be connected to a connector 73*e* of a cap receiving section 73 in the state in which the cap 34Y is attached to the toner container holder 70 (the cap receiving section 73) (see FIG. 6). Specifically, in the state in which the cap 34Y is attached to the toner container holder 70 (the cap receiving section 73), multiple metallic pads 35*a* (metallic plates) of the ID chip 35 come in contact with multiple apparatus main-body terminals 73*e*2 of the connector 73*e*. The ID chip 35 performs communication (wire communication) with a control unit (not illustrated) via the connector 73*e* in the state in which the cap 34Y is held by the cap receiving section 73.

Referring to FIG. 2 to FIG. 5, in the first embodiment, a holding mechanism installed in the toner container 32Y that is removably installed in the image forming apparatus main body 100 includes the ID chip 35, the holding portion 34*k*, and the like. The ID chip 35 held on the holding mechanism includes a substrate 35*b*, an information storage unit 35*c*, the metallic pads 35*a* (metallic plates) serving as multiple terminals, and the like.

Figure 5:
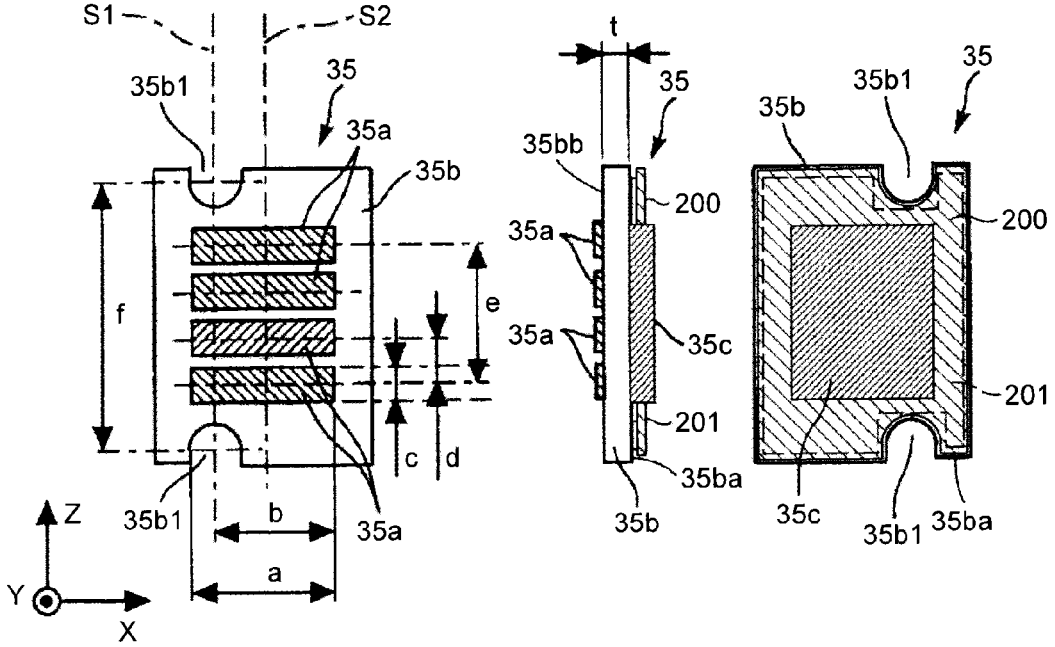
FIG. 5 is a three-plane view illustrating the information storage device.

Referring to FIG. 5, the information storage unit 35*c* is an electronic circuit in which various pieces of information to be exchanged between the control unit 90 of the image forming apparatus main body 100 and the toner container 32Y are stored. In FIG. 5, the information storage unit 35*c* is illustrated as a box-shaped object indicated by hatched lines for simplicity, but corresponds to an assembly of a memory IC, a condenser for noise reduction, a resistor, and the like. The information storage unit 35*c* is arranged on a back surface 35*ba* of the substrate 35*b* (a surface opposite to a surface that comes in contact with the apparatus main-body terminals 73*e*2), and electrically connected to all or some of the metallic pads 35*a* serving as the multiple metallic plates.

The metallic pads 35*a* as the multiple terminals come in contact with the multiple respective apparatus main-body terminals 73*e*2 of the connector 73*e* provided in the cap receiving section 73 (the image forming apparatus main body 100), and exchange electrical signals related to information with the image forming apparatus main body 100 (the control unit 90). The multiple metallic pads 35*a* are arranged on a front surface 35*bb*, which serves as the surface that comes in contact with the apparatus main-body terminals 73*e*2, in the substrate 35*b*. Further, the multiple metallic pads 35*a* are formed in approximately rectangular shapes and arranged side by side in a transverse direction thereof with a clearance therebetween.

On the substrate 35*b* on which the information storage unit 35*c* and the metallic pads 35*a* are arranged, positioning notches (openings) 35*b*1 serving as guides (each having a shape of a half an elliptical circumference divided into two by a straight line) are respectively provided on both ends in the vertical direction. The positioning notches 35*b*1 are fitted to positioning pins 73*e*3 serving as cylindrical positioning protrusions (i.e., an apparatus main-body protrusions) provided in the connector 73*e* (see FIG. 6), and determines positions of the multiple metallic pads 35*a* relative to the multiple apparatus main-body terminals 73*e*2. The ID chip 35 configured as above is held by the holding portion 34*k* that is configured to be detachably attachable to the cap 34Y.

The holding portion 34*k* holds the ID chip 35 so as to allow movement on a virtual plane intersecting with (virtual plane approximately perpendicular to) a moving direction (a direction of a white arrow in FIG. 6) in which the metallic pads 35*a* (terminals) approach and come in contact with the apparatus main-body terminals 73*e*2.

Specifically, in the first embodiment, the holding portion 34*k* holds the ID chip 35 (the substrate 35*b*) so as to allow movement on the virtual plane (an XZ plane in FIG. 2) perpendicular to an attachment/detachment direction of the toner container 32Y with respect t the image forming apparatus main body 100. In other words, the ID chip 35 (the substrate 35*b*) is configured to be able to move on the XZ plane in FIG. 2 freely to some extent (to move about 1 mm) in a state of being held by the holding portion 34*k* (the cap 34Y) as illustrated in FIG. 2. Specifically, the ID chip 35 (the substrate 35*b*) is held loosely to some extent inside the box-shaped holding portion 34*k*. Namely, the ID chip 35 is held with a predetermined interval with respect to a side wall in the XZ plane direction inside the holding portion 34*k*. Further, referring to FIG. 4 and FIG. 5, the ID chip 35 is held such that a small clearance Δt (for example, Δt+t=about 0.85 to 1.05 mm) is formed in a ±Y direction with respect to the thickness t (about 0.8 mm) of the substrate 35*b* inside the holding portion 34*k*. Therefore, it is possible to stand the substrate 35*b* so as to approximately perpendicularly cross an insertion direction of the positioning pins 73*e*3. Consequently, it becomes possible to prevent the substrate 35*b* from being excessively laid down in the insertion direction of the positioning pins 73*e*3 and prevent the positioning pins 73*e*3 and the notches 35*b*1 from being caught together and failing to be fitted to each other.

In the above described configuration, with a decrease in the size of the image forming apparatus main body 100 or the toner container 32Y, the multiple metallic pads 35*a* (terminals) may be densely arranged on the substrate 35*b* in order to reduce the size of the ID chip 35 installed therein. Even in this case, a contact failure caused by a positioning failure between the multiple metallic pads 35*a* and the apparatus main-body terminals 73*e*2 of the connector 73*e* is less likely to occur regardless of whether the dimensional accuracy or assembly accuracy of associated components is high or low.

FIG. 5 is a three-plane view illustrating the ID chip 35.

As illustrated in FIG. 5, the metallic pads 35*a* as four metallic plates are arranged side by side in the Z-direction on a first plane (the front surface 35*bb*) of the substrate 35*b* of the ID chip 35. The metallic pads 35*a* have multi-layer structures having three layers of a copper layer, a nickel layer, and a metallic layer disposed in this order from the substrate 35*b* side, and the metallic layer serving as a surface layer is disposed to prevent oxidization although it is relatively expensive. Further, the metallic pads 35*a* are formed by electric field deposition on the substrate 35*b* that is masked in advance.

The positioning notches 35*b*1 are provided on both ends in the arrangement direction (the Z direction) of the four metallic pads 35*a* so as to sandwich the four metallic pads 35*a*. A first virtual straight line S1 that passes through the centers of the notches 35*b*1 and is parallel to the arrangement direction of the multiple metallic pads 35*a* is configured to be positioned so as not to overlap with a second virtual straight line S2 that connects the centers of the multiple metallic pads 35*a* in the longitudinal direction. Specifically, the first virtual straight line S1 connecting the two positioning notches 35*b*1 is configured to be positioned so as not to overlap with the second virtual straight line S2 connecting the centers of the multiple metallic pads 35*a* in the longitudinal direction. In other words, the virtual straight line S1 connecting portions of the notches 35*b*1 that are most bitten toward the inside of the substrate 35*b* is positioned so as not to overlap the virtual straight line S2. Further, the virtual straight line S1 is configured to be approximately parallel to the virtual straight line S2.

In the first embodiment, dimensions a to f in FIG. 5 are set to 6.2 mm, 5.2 mm, 1.5 mm, 2 mm, 6 mm, and 11.7 mm, respectively. The substrate 35*b* having a small area size as described above is small in an absolute deflection amount even if an external force is applied, and is relatively large in resistance (stiffness) against a shearing force. In the first embodiment, the ID chip 35 is movably held inside the holding portion 34*k*, and a positioning method is employed, in which "forced insertion" may occur due to insertion of the positioning pins 73*e*3 into the notches 35*b*1 when the ID chip 35 has a large area size. The "forced insertion" is a state in which the positioning pins 73*e*3 are inserted into the notches 35*b*1 obliquely rather than vertically, and sliding loads between the notches 35*b*1 and the positioning pins 73*e*3 serving as the apparatus main-body protrusions increase, so that the substrate 35*b* is deflected and does not move. However, in the first embodiment, the stiffness is increased by taking advantage of the small area size of the substrate 35*b* as described above, and a positioning method that is less likely to cause deflection to be a cause of the "forced insertion" is implemented. Further, although the intervals among the metallic pads 35*a* on the substrate 35*b* are narrow, it is possible to prevent a contact failure between the metallic pads 35*a* and the apparatus main-body terminals 73*e*2 because of highly accurate positioning along with movement of the substrate 35*b* in the XZ plane. Therefore, it becomes possible to suppress the area size of the expensive metallic pads 35*a* having the metallic layer to the minimum.

As illustrated in FIG. 3, on a side opposite to the front surface 35*bb* that serves, in the substrate 35*b* of the ID chip 35, as the surface to be in contact with the apparatus main-body terminal 73*e*2, a sliding improving member 200 serving as a low frictional structure is arranged between the substrate 35*b* and an inner wall 34*k*5 of the holding portion 34*k*. Namely, the sliding improving member 200 is arranged in a contact area between the ID chip 35 (the substrate 35*b*) and the holding portion 34*k*. The sliding improving member 200 is made up of, for example, polyethylene terephthalate (hereinafter, referred to as "PET") as a resin material with high slidability, high wear and abrasion resistance, and a low friction coefficient in order to improve the slidability between the inner wall 34*k*5 and the substrate 35*b*. In the first embodiment, as illustrated in FIG. 5, the sliding improving member 200 is mounted by being attached to the back surface 35*ba* of the substrate 35*b* excluding the information storage unit 35*c* with an adhesive member 201, such as a double-stick tape. It is preferable that a thickness of the sliding improving member 200 be at least about 0.1 mm. If the operability is taken into account, it is preferable that the thickness be thicker than 0.1 mm, and more preferably, be at least about 0.2 mm.

By arranging the sliding improving member 200 between the ID chip 35 (the substrate 35*b*) and the inner wall 34*k*5 as described above, contact resistance between the ID chip 35 (the substrate 35*b*) and the inner wall 34*k*5 is reduced and the slidability is improved. Therefore, when the positioning pins 73*e*3 serving as the apparatus main-body protrusions move by being guided by the notches 35*b*1 of the substrate 35*b*, it is possible to prevent the apparatus main-body protrusions 73*e*3 and the notches 35*b*1 of the substrate 35*b* from being caught together. Further, it becomes possible to accurately set the toner container 32Y in the image forming apparatus main body 100, enabling to prevent occurrence of a communication failure.

Second Embodiment

Figure 6:
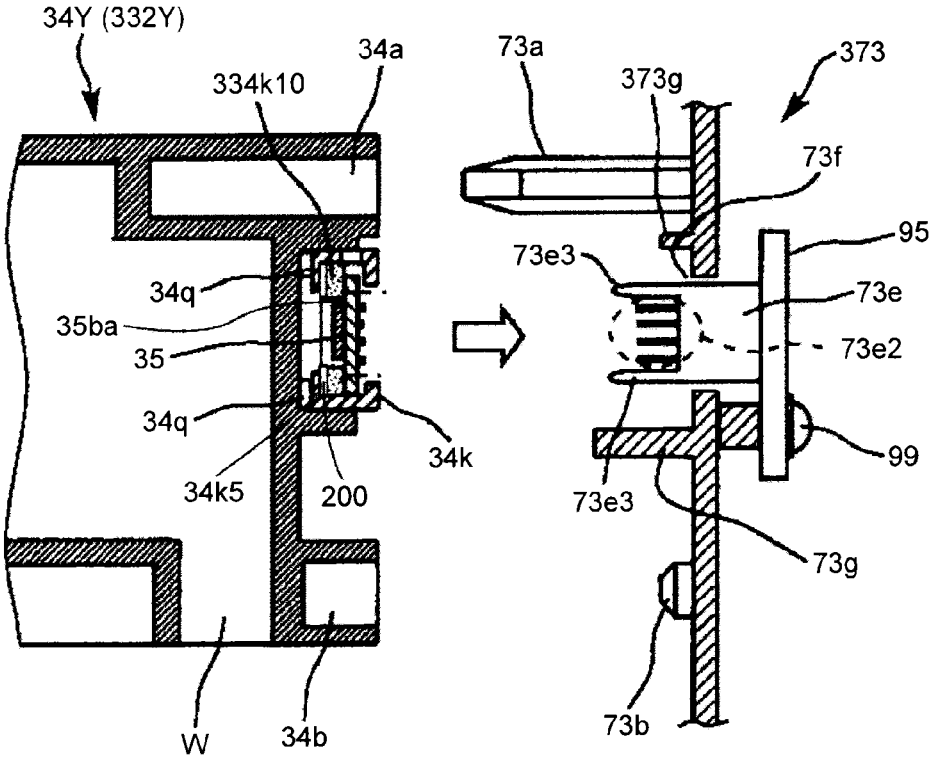
FIG. 6 is a schematic diagram illustrating a state in which an information storage device of a toner container according to a second embodiment of the present invention is set in a connector of a cap receiving section.

With reference to FIG. 6, a second embodiment of the present invention will be described in detail.

FIG. 6 is a schematic diagram illustrating a state in which the ID chip 35 (information storage device) of a toner container 332Y according to the second embodiment is set in the connector 73*e* of the cap receiving section 73, and is a diagram corresponding to FIG. 3 in the first embodiment.

The second embodiment differs from the first embodiment in that a cushion material 334*k*10 is provided inside the holding portion 34*k* and a wall 373*g* of a cap receiving section 373 is configured in a different manner.

The toner container 332Y according to the second embodiment includes a container body 33Y and the cap 34Y similarly to the other embodiments. In the cap 34Y, the ID chip 35 as the information storage device is removably installed. Further, the ID chip 35 is held so as to be able to move in the XZ plane inside the holding portion 34*k*.

In the second embodiment, the cushion material 334*k*10 is provided between the inner wall 34*k*5 of the holding portion 34*k* and the substrate 35*b*. The cushion material 334*k*10 is made of elastic material, such as foamed polyurethane, and is attached to the back surface 35*ba* of the substrate 35*b*. Therefore, it is possible to reduce damage on the substrate 35*b* when the positioning pins 73*e*3 are fitted to the notches 35*b*1 without precluding the ID chip (the substrate 35*b*) from moving in the XZ plane.

In the second embodiment, the sliding improving member 200 is arranged between the cushion material 334*k*10 and the inner wall 34*k*5. In the second embodiment, the sliding improving member 200 is arranged by being attached to the cushion material 334*k*10 side with the adhesive member 201, such as a double-stick tape.

In the second embodiment, the wall 373*g* of the cap receiving section 373 is arranged so as to surround four sides of the connector 73*e*. Further, a recess for preventing interference with the wall 373*g* is provided in the cap 34Y in a corresponding manner. By providing the wall 373*g* as described above, even when toner scatters from the vicinity of a toner outlet W of the toner container 332Y to the outside, the scattered toner is less likely to adhere directly to the connector 73*e* or the ID chip 35. Therefore, it becomes possible to prevent a contact failure (communication failure) between the connector 73*e* (the apparatus main-body terminals 73*e*2) and the ID chip 35 (the metallic pads 35*a*) due to the scattered toner.

Even in the second embodiment, similarly to the first embodiment, the contact-type ID chip 35 is held on the holding portion 34*k* so as to be able to move on a virtual plane approximately perpendicular to the moving direction in which the metallic pads 35*a* approach and come in contact with the apparatus main-body terminals 73*e*2. Therefore, even when the ID chip 35 is installed in the toner container 332Y that is removably installed in the image forming apparatus main body 100, a contact failure caused by a positioning failure with respect to the apparatus main-body terminals 73*e*2 of the connector 73*e* of the image forming apparatus main body 100 is less likely to occur.

Further, the sliding improving member 200 is arranged between the cushion material 334*k*10 provided on the back surface 35*ba* of the substrate 35*b* and the inner wall 34*k*5. Therefore, contact resistance between the ID chip 35 (the substrate 35*b*) and the inner wall 34*k*5 is reduced and the slidability is improved, so that when the positioning pins 73*e*3 serving as the apparatus main-body protrusions moves by being guided by the notches 35*b*1 of the substrate 35*b*, it becomes possible to prevent the apparatus main-body protrusions 73*e*3 and the notches 35*b*1 of the substrate 35*b* from being caught together. As a result, it becomes possible to accurately set the toner container 332Y in the image forming apparatus main body 100, enabling to more reliably prevent occurrence of a communication failure.

Third Embodiment

Figure 7:
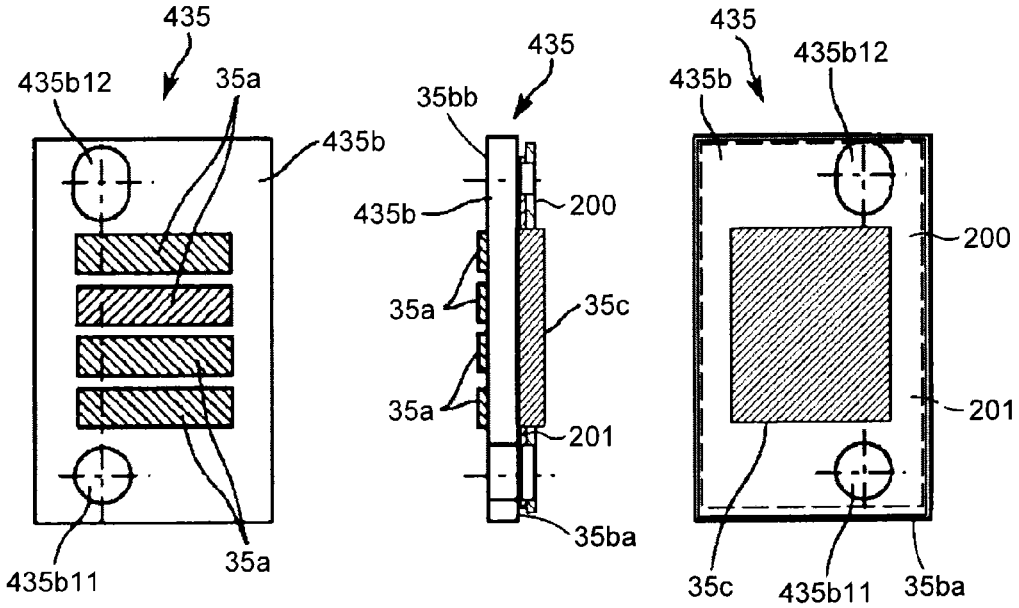
FIG. 7 is a three-plane view illustrating a substrate of an information storage device according to a third embodiment of the present invention.

With reference to FIG. 7, a third embodiment of the present invention will be described in detail.

FIG. 7 is a three-plane view illustrating a substrate 435*b* of an ID chip 435 serving as an information storage device according to the third embodiment.

A toner container (432Y) according to the third embodiment includes the container body 33Y and the cap 34Y similarly to the above described embodiments. In the cap 34Y, the ID chip 435 as the information storage device is removably installed. Further, the ID chip 435 is held so as to be able to move in the XZ plane inside the holding portion 34*k*.

On the substrate 435*b* of the ID chip 435 according to the third embodiment, positioning holes 435*b*11 and 435*b*12 serving as guides are provided so as to penetrate through the substrate 435*b*, instead of the positioning notches 35*b*1 of the above described embodiments. Along with an attachment operation of the toner container (432Y), the substrate 435*b* freely moves in the XZ plane and the positioning holes 435*b*11 and 435*b*12 are fitted to the positioning pins 73*e*3 of the connector 73*e* to be inserted. Specifically, edges (or inner surfaces) of the holes 435*b*11 and 435*b*12 come in contact with the positioning pins 73*e*3, so that the movement of the substrate 435*b* is regulated. Accordingly, a contact failure caused by a positioning failure between the multiple metallic pads 35*a* and the apparatus main-body terminals 73*e*2 of the connector 73*e* is less likely to occur. In the third embodiment, the sliding improving member 200 is arranged by being attached to a back surface 435*ba* of the substrate 435*b* with the adhesive member 201.

In the third embodiment, the positioning hole 435*b*11 in a circular shape is formed in the lower side of the substrate 435*b*, and the positioning hole 435*b*12 in a long-hole shape is formed in the upper side of the substrate 435*b*. This is done by taking into account the fact that the substrate 435*b* is positioned in the lower side inside the holding portion 34*k* due to the weight of the substrate 435*b* just before the positioning holes 435*b*11 and 435*b*12 are fitted to the positioning pins 73*e*3. The hole 435*b*11 in the lower side is picked up by the positioning pin 73*e*3, so that the substrate 435*b* is lifted up and the positioning pin 73*e*3 can be smoothly inserted in the other long hole (the hole 435*b*12). If the hole in the lower side is a long hole and the hole in the upper side is a circular hole, it may become difficult to lift up the substrate 435*b* by the positioning pin 73*e*3, making it difficult to insert the positioning pin 73*e*3 in the circular hole in the upper side.

In the third embodiment, the two positioning holes 435*b*11 and 435*b*12 are formed in the substrate 435*b* of the ID chip 435. In contrast, in the substrate 435*b* of the ID chip 435, it may be possible to form the positioning hole 435*b*11 (or 435*b*12) on one side and form the positioning notch 35*b*1 (used in the above described embodiments) on the other side. Even in this case, the same advantageous effects as those of the third embodiment can be obtained.

Even in the third embodiment, similarly to the other embodiments, the contact-type ID chip 435 is held by the holding portion 34*k* so as to be able to move on a virtual plane approximately perpendicular to the moving direction in which the metallic pads 35*a* approach and come in contact with the apparatus main-body terminals 73*e*2. Therefore, even when the ID chip 435 is installed in the toner container that is removably installed in the image forming apparatus main body 100, a contact failure caused by a positioning failure with respect to the apparatus main-body terminals 73*e*2 of the connector 73*e* of the image forming apparatus main body 100 is less likely to occur.

The positioning hole 435*b*11 in the lower side is picked up and guided by the positioning pin 73*e*3, so that the substrate 435*b* is lifted up and moved, and the positioning pin 73*e*3 is guided to and inserted in the other long hole (the positioning hole 435*b*12). In this case, because the sliding improving member 200 is arranged on the back surface 435*ba* of the substrate 435*b*, contact resistance between the ID chip 435 (the substrate 435*b*) and the inner wall 34*k*5 is reduced and the slidability is improved. Therefore, it becomes possible to prevent the positioning pins 73*e*3 (serving as the apparatus main-body protrusions) and the holes 435*b*11 and 435*b*12 of the substrate 435*b* from being caught or locked together. As a result, it becomes possible to accurately set the toner container 432Y in the image forming apparatus main body 100, enabling to more reliably prevent occurrence of a communication failure.

Fourth Embodiment

With reference to FIG. 8 to FIGS. 10A and 10B, a fourth embodiment of the present invention will be described in detail.

Figure 8:
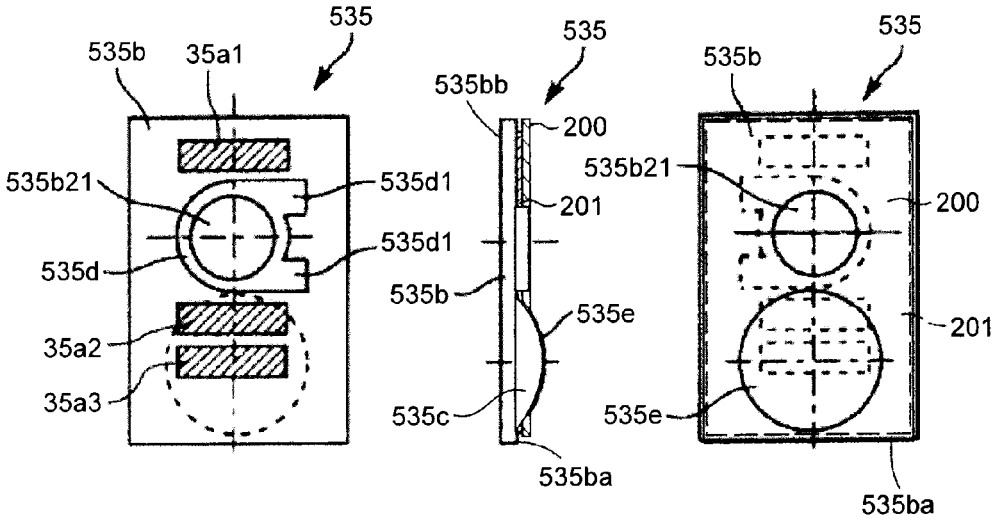
FIG. 8 is a three-plane view illustrating a substrate of an information storage device according to a fourth embodiment of the present invention.
Figure 9:
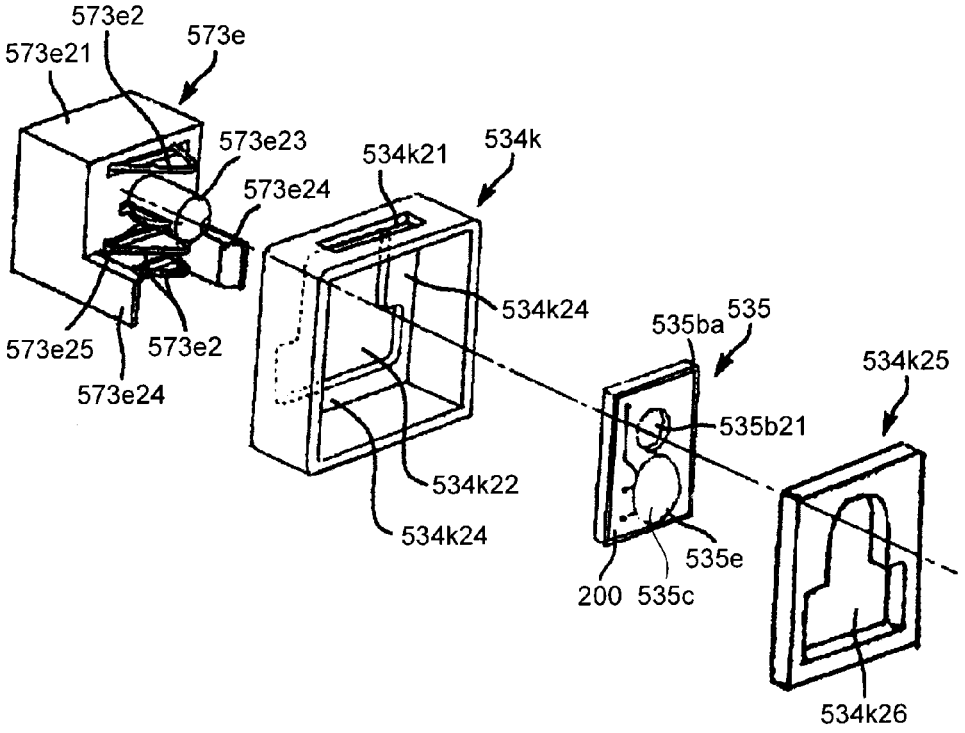
FIG. 9 is a perspective view illustrating the information storage device, a holding portion, and a connector.
Figure 10A:
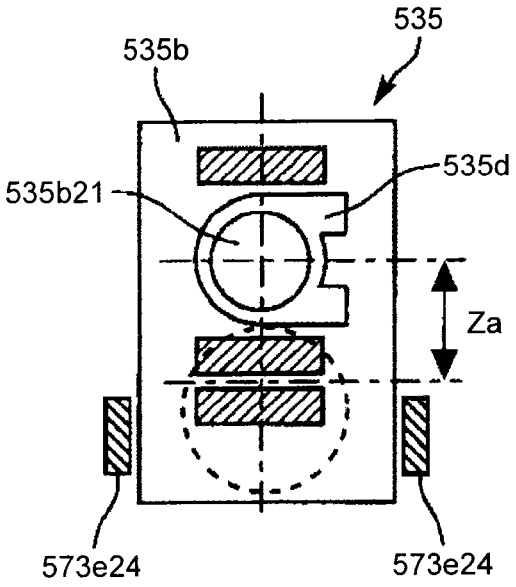
FIGS. 10A and 10B are plan views illustrating the information storage device.
Figure 10B:
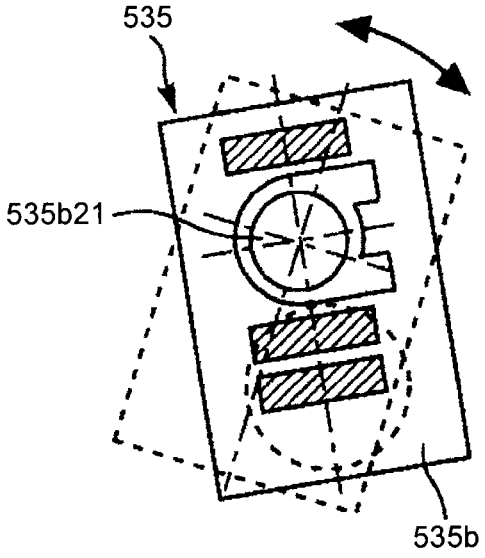

FIG. 8 is a three-plane view illustrating a substrate 535*b* of an ID chip 535 serving as an information storage device according to the fourth embodiment, and is a diagram corresponding to FIG. 5 in the above described first embodiment. FIG. 9 is a perspective view illustrating the ID chip 535, a holding portion 534*k* (534*k*25), and a connector 573*e*, and is a perspective view illustrating a relative positional relation among the three members 534*k* (534*k*25), 535, and 573*e*. FIG. 10A is a front view illustrating a state in which the ID chip 535 is held on the connector 573*e*. FIG. 10B is a front view illustrating a state in which the ID chip 535 rotates about a positioning hole 535*b*21 serving as a guide.

In the fourth embodiment, the single positioning hole 535*b*21 is formed on the substrate 535*b* of the ID chip 535. In the fourth embodiment, the positioning hole 535*b*21 is arranged between multiple rectangular metallic pads (metallic plates) 35*a*1, 35*a*2, and 35*a*3. These two points differ from the above described other embodiments.

Referring to FIG. 8, in the ID chip 535 of the fourth embodiment, the positioning hole 535*b*21 is formed in an upper position relative to the center of gravity of the substrate 535*b* in the vertical direction so as to penetrate through the substrate 535*b*. Further, on an inner diameter portion and a periphery of the hole 535*b*21, a metallic terminal 535*d* for grounding (earth) is provided. In the fourth embodiment, the metallic terminal 535*d* provided on a front surface 535*bb* of the substrate 535*b* serving as a surface that comes in contact with the apparatus main-body terminals 73*e*2 is formed such that two projections 535*d*1 extend in the horizontal direction from a ring-shaped part. Further, the single rectangular metallic pad 35*a*1 is provided in a position above the positioning hole 535*b*21 in the vertical direction, and the two rectangular metallic pads 35*a*2 and 35*a*3 are provided in positions below the positioning hole 535*b*21 in the vertical direction.

On a back surface 535*ba* (a surface opposite to the surface that comes in contact with the apparatus main-body terminals 73*e*2) of the substrate 535*b*, a hemispherical protector 535*e* that is made of resin material, such as epoxy, and that covers and protects an information storage unit 35*c* is provided. In the fourth embodiment, the information storage unit 35*c*, such as an IC, is provided thereinside although it depends on the shape of the substrate 535*b* or the configuration or arrangement of a back surface of the protector 535*e*. For this reason, the hole 535*b*21 is arranged in the upper side of the protector 535*e* that is a largest and heaviest structural body on the back surface 535*ba*. Therefore, a positional relation in which the hole 535*b*21 is located in the vertically upper side relative to the center of gravity of the ID chip 535 as described above is realized. Specifically, referring to FIG. 10A, the ID chip 535 of the fourth embodiment is formed such that a center position of the positioning hole 535*b*21 is at a distance Za above the center of gravity of the ID chip 535.

The sliding improving member 200 is arranged by being attached to the back surface 535*ba* of the substrate 535*b* excluding the positioning hole 535*b*21 and the protector 535*e* with the adhesive member 201. The back surface 535*ba* faces the second opposing portion 534*k*25 of the holding portion 534*k* illustrated in FIG. 9.

With reference to FIG. 9, the connector 573*e* includes a connector main body 573*e*21 that is a hollow box made of resin. In the connector main body 573*e*21, a positioning pin 573*e*23 (positioning protrusion) that is a single hollow cylinder with a tapered-shaped front end is provided so as to stand in the horizontal direction. Further, an apparatus main-body terminal (earth terminal) 573*e*25 for grounding is provided in the positioning pin 573*e*23. The apparatus main-body earth terminal 573*e*25 is a plate-shaped (or linear) metallic member and a part thereof is housed in a hollow portion of the positioning pin 573*e*23 that is integrated with the connector main body 573*e*21. A curved portion of the apparatus main-body earth terminal 573*e*25 is exposed from a slit-shaped opening formed in a part of a circumferential surface of the hollow cylinder and protrudes from the outer circumferential surface of the cylinder. With respect to the positioning pin 573*e*23 (the apparatus main-body earth terminal 573*e*25), the single apparatus main-body terminals 73*e*2 is provided in an upper position in the vertical direction, and the two apparatus main-body terminals 73*e*2 are provided in a lower position in the vertical direction. The apparatus main-body terminals 73*e*2 are plate-shaped (or linear) metallic members that are formed in an approximately same manner as those of the above described embodiments, except that their arrangement positions are different.

Oscillation preventing members 573*e*24 are provided in positions on both sides sandwiching the positioning pin 573*e*23 in the lower side of the connector main body 573*e*21. The oscillation preventing members 573*e*24 are formed of a pair of ribs that are formed such that inner tapered surfaces of the respective front ends are line symmetrically arranged, and function as regulators opposing each other on both end surfaces of the ID chip 535 in a vertically lower side relative to the center of the hole 535*b*21.

The holding portion 534*k* is fixed to a toner container (632Y) and located between the connector 573*e* and the ID chip 535, similarly to the above described embodiments. The shape of the holding portion 534*k* is approximately the same as those of the above described embodiments, and a function (a function to hold the ID chip 535 such that the ID chip 535 can move in the XZ plane) is also the same. Referring to FIG. 9, the holding portion 534*k* of the fourth embodiment is formed such that a first opposing portion 534*k*24 is line symmetric with respect to an axis in the vertical direction and such that an area from upper two corners of the ID chip 535 to both sides of the hole 535*b*21 are covered. Further, the holding portion 534*k* is formed so as to cover a lower side relative to the bottommost metallic pad 35*a*3 on the substrate 535*b* even in the lower side. With this configuration, the ID chip 535 is prevented from coming off from the holding portion 534*k*.

In the holding portion 534*k*, a large part of the first opposing portion 534*k*24 including an area opposing the four apparatus main-body terminals 573*e*2 and 573*e*25 of the connector 573*e* is formed as an opening. In particular, in the holding portion 534*k*, a convex-shaped opening 534*k*22 is opened so as to open a portion corresponding to the pair of the oscillation preventing members 573*e*24. At the time of attachment of the toner container 632Y, the positioning pin 573*e*23 enters the opening 534*k*22, and subsequently, the oscillation preventing members 573*e*24 enter the inside of the holding portion 534*k* via the opening 534*k*22.

The second opposing portion 534*k*25, which has a flat plate shape and serves as a holder facing the back surface 535*ba* side of the ID chip 535, is fixed to the holding portion 534*k* by bonding, snap-fit (not illustrated), or the like. The second opposing portion 534*k*25, similarly to the first opposing portion 534*k*24, includes a convex-shaped opening 534*k*26 and can prevent interference with the protector 535*e* or the oscillation preventing members 573*e*24 to be inserted. On the contrary, the ID chip 535 is pushed when the positioning pin 573*e*23 is inserted in the hole 535*b*21 of the ID chip 535. However, the second opposing portion 534*k*25 supports the back side of the substrate 535*b*, so that a contact state of the terminals can be maintained.

In a series of attachment operations of the toner container 632Y, positioning holes 34*a* and 34*b* serving as a main reference and a sub reference of a cap 634Y (see FIGS. 11A and 11B) are fitted to positioning pins 73*a* and 73*b* serving as a main reference and a sub reference of the cap receiving section 73, so that positioning of the cap 634Y is performed. Operations so far are the same as the attachment operations of the first embodiment. Subsequently, after a position of the cap 634Y is determined, the hole 535*b*21 of the ID chip 535 is guided by being picked up by the taper of the front end of the positioning pin 573*e*23 of the connector 573*e* and fitted to the positioning pin 573*e*23. Therefore, the positions of the ID chip 535 in the horizontal direction and the vertical direction are determined simultaneously. Further, as illustrated in FIG. 10A, the oscillation preventing members 573*e*24 of the connector 573*e* enter lower edges on the left and right sides of the substrate 535*b* in the lower side relative to the center of the hole 535*b*21. In this case, it is assumed that the posture of the ID chip 535 is displaced as illustrated in FIG. 10B. Even in this case, if the tapered surfaces of the front ends of the ribs come in contact with the edges, the substrate 535*b* is triggered to rotate in a direction in which the posture is vertically oriented by the action of the center of gravity. Then, displacement of the posture in the rotation direction (rotation in the direction of a double-headed arrow illustrated in FIG. 10B) is corrected (to obtain a state illustrated in FIG. 10A). Consequently, positioning of the ID chip 535 is completed. In this case, a part of the earth terminal 535*d* of the ID chip 535 (a part corresponding to the inner diameter portion of the hole 535*b*21) comes in contact with the apparatus main-body earth terminal 573*e*25 of the positioning pin 573*e*23 illustrated in FIG. 9, so that a connection to earth (electrical connection) of the ID chip 535 is established.

Fifth Embodiment

Figure 11A:
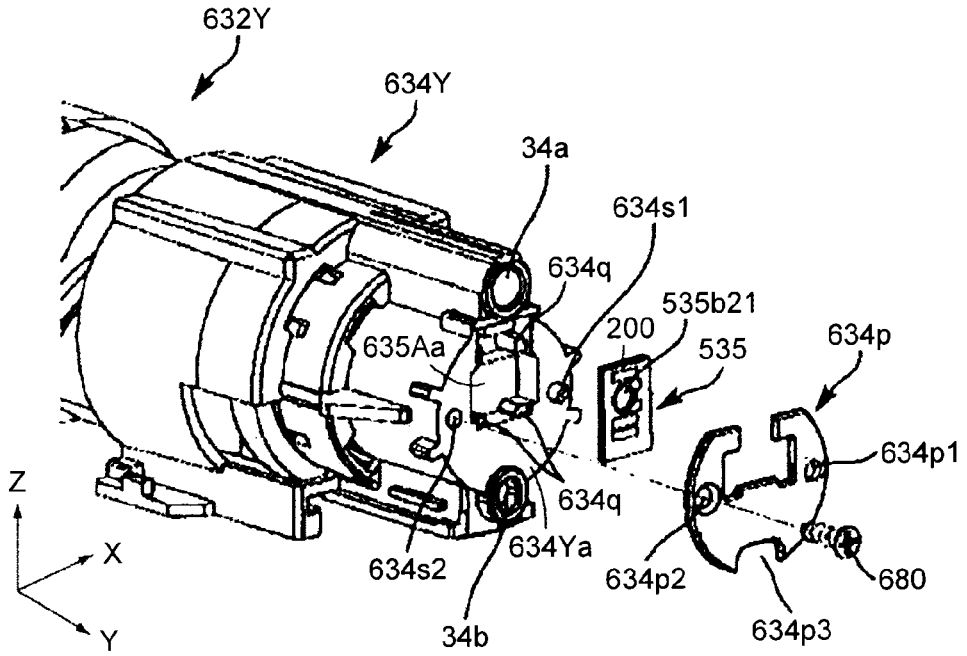
FIGS. 11A and 11B are perspective views illustrating a toner container according to a fifth embodiment of the present invention.
Figure 11B:
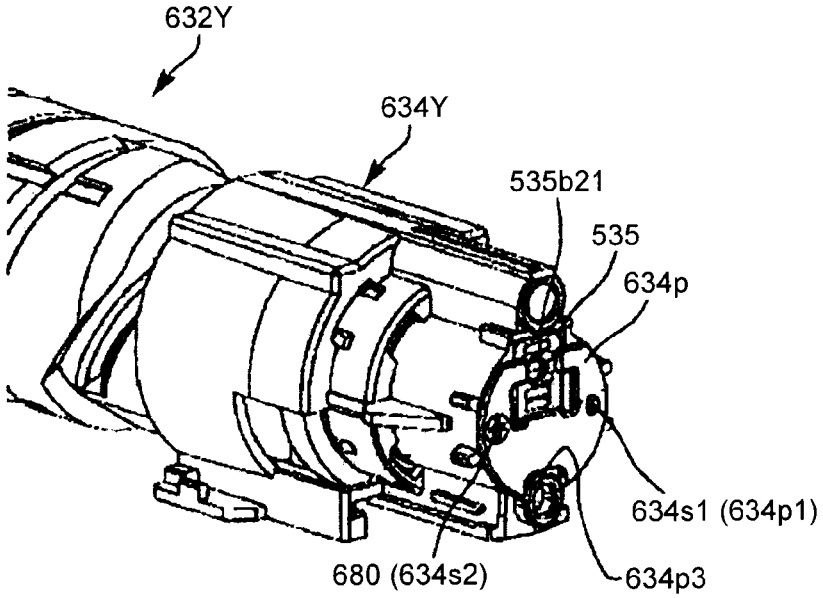

With reference to FIGS. 11A and 11B, a fifth embodiment of the present invention will be described in detail.

FIGS. 11A and 11B are perspective views illustrating a toner container 632Y serving as a removable device according to the fifth embodiment. FIG. 11A is an exploded view illustrating a state before the ID chip 535 described in the fourth embodiment is attached. FIG. 11B is a diagram illustrating a state in which the ID chip 535 is attached.

In the fifth embodiment, the ID chip 535 is the same as that of the fourth embodiment, and the ID chip 535 is movably inserted in a recess 635Aa formed on an end surface 634Ya of a cap 634Y facing an attachment section. The ID chip 535 differs from that of the fourth embodiment in that it is held on a faceplate 634*p* so as to be able to move in the XZ direction, and other configurations thereof are the same as those of the fourth embodiment.

Figure 12:
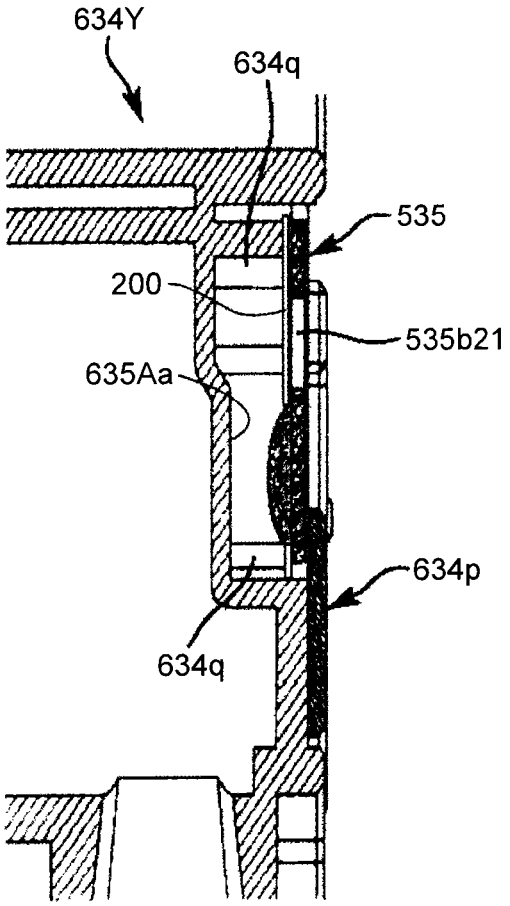
FIG. 12 is a cross-sectional view illustrating the toner container in a state in which the information storage device and a faceplate are mounted.

In the fifth embodiment, with reference to FIGS. 11A and 11B and FIG. 12, the ID chip 535 is not installed in the cap 634Y in a state of being movably inserted in the holding portion 534*k*. In the fifth embodiment, the faceplate 634*p* for preventing coming off is screwed to the cap 634Y in a state in which the ID chip 535 is movably inserted in the recess 635Aa formed on the cap 634Y.

More specifically, with reference to FIG. 11A, the recess 635Aa for holding the ID chip 535 such that the ID chip 535 can move in the XZ plane is formed on the end surface 634Ya of the cap 634Y. In the recess 635Aa, multiple supporting parts 634*q* serving as holders that come in surface contact with only a part of the ID chip 535 are formed. In a state in which the ID chip 535 is movably inserted in the recess 635Aa of the cap 634Y, the faceplate 634*p* for preventing the ID chip 535 from coming off from the recess 635Aa is installed. Referring to FIG. 11B and FIG. 12, similarly to the fourth embodiment, the faceplate 634*p* is screwed to a part of the substrate 535*b* of the ID chip 535 in a state in which the metallic pads 35*a*1, 35*a*2, and 35*a*3, the positioning hole 535*b*21 (the earth terminal 535*d*), and the like are exposed.

In the fifth embodiment, the sliding improving member 200 is arranged between the back surface 535*ba* side of the ID chip 535 and the supporting parts 634*q* in the recess 635Aa facing the ID chip 535. Therefore, contact resistance between the ID chip 535 (the substrate 535*b*) and the supporting parts 634*q* (holder) is reduced and the slidability is improved, so that it becomes possible to prevent the positioning pin 573*e*23 (protrusion) and the hole 535*b*21 of the substrate 535*b* from being caught or locked together. As a result, it becomes possible to accurately set the toner container 632Y (removable device) in the image forming apparatus main body 100, enabling to more reliably prevent occurrence of a communication failure.

Sixth Embodiment

Figure 13:
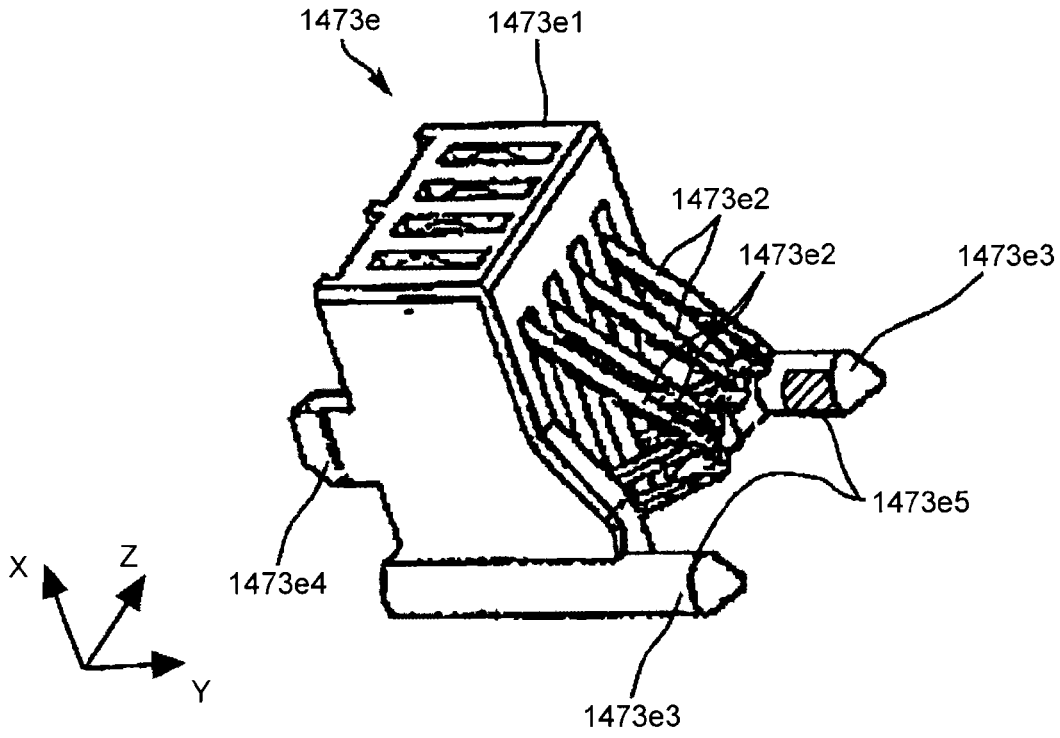
FIG. 13 is a perspective view illustrating a connector of an image forming apparatus according to a sixth embodiment of the present invention.
Figure 14:
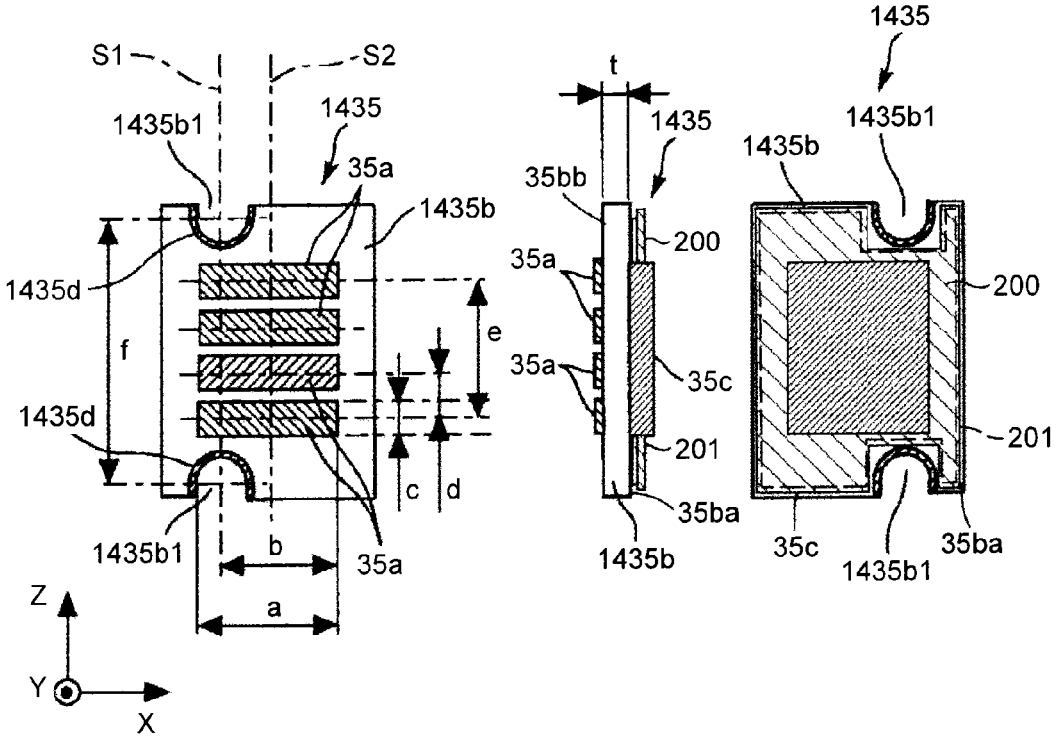
FIG. 14 is a three-plane view illustrating an information storage device that comes in contact with a connector in FIG. 13.
Figure 15:
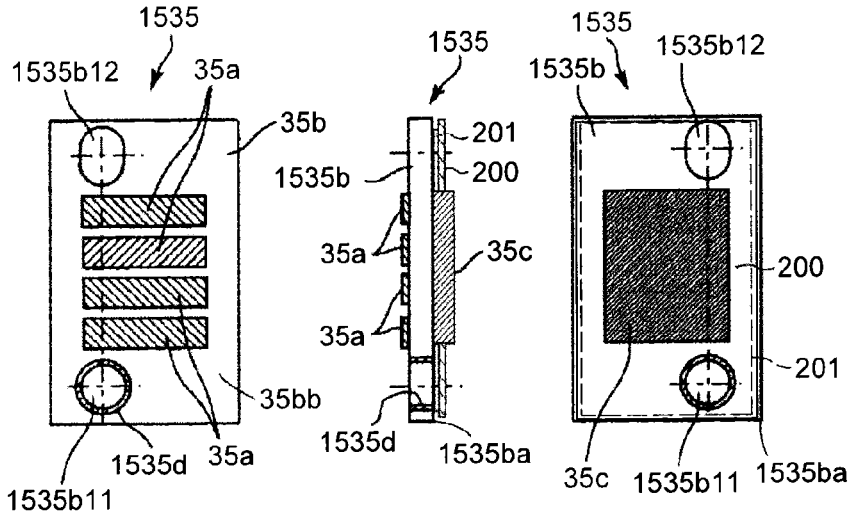
FIG. 15 is a three-plane view illustrating an information storage device according to another embodiment.

With reference to FIG. 13 to FIG. 15, a sixth embodiment of the present invention will be described in detail.

FIG. 13 is a perspective view illustrating a connector 1473*e* of an image forming apparatus according to the sixth embodiment. FIG. 14 is a three-plane view illustrating an ID chip 1435 serving as an information storage device that comes in contact with the connector 1473*e* illustrated in FIG. 13, and is a diagram corresponding to FIG. 5 in the above described first embodiment. FIG. 15 is a three-plane view illustrating an ID chip 1535 serving as an information storage device according to another embodiment.

In the sixth embodiment, apparatus main-body terminals (earth terminals) 1473*e*5 for grounding are provided in positioning pins 1473*e*3 of the connector 1473*e*. Further, metallic terminals (earth terminals) 1435*d* and 1535*d* for grounding, which come in contact with the apparatus main-body earth terminals 1473*e*5 are provided in the ID chips 1435 and 1535, respectively. These two points differ from the first and the third embodiments.

With reference to FIG. 13, the connector 1473*e* is provided in the image forming apparatus according to the sixth embodiment. The connector 1473*e* includes, similarly to that of the first embodiment, a connector main body 1473*e*1, four apparatus main-body terminals 1473*e*2, the two positioning pins 1473*e*3 (positioning protrusions), a snap-fit 1473*e*4, and the like. In the connector 1473*e* according to the sixth embodiment, the apparatus main-body earth terminals 1473*e*5 are provided in inner sides of the positioning pins 1473*e*3 (in portions that come in contact with notches 1435*b*1 of the ID chip 1435 or a hole 1535*b*11).

Meanwhile, with reference to FIG. 14, in the ID chip 1435 (a substrate 1435*b*) according to the sixth embodiment, the metallic terminals (earth terminals) 1435*d* for grounding are provided in inner diameter portions and peripheries of the two notches 1435*b*1 serving as guides. Further, the sliding improving member 200 is arranged by being attached to a back surface 1435*ba* of the substrate 1435*b* excluding the information storage unit 35*c* with the adhesive member 201.

With this configuration, in the attachment operation of the toner container, the earth terminals 1435*d* of the ID chip 1435 come in contact with the apparatus main-body earth terminals 1473*e*5 of the positioning pins 1473*e*3 (the connector 1473*e*). Thereafter, the four metallic pads 35*a* of the ID chip 1435 start to come in contact with the four apparatus main-body terminals 1473*e*2 of the connector 1473*e*. In other words, in the detachment operation of the toner container, contact between the four metallic pads 35*a* of the ID chip 1435 and the four apparatus main-body terminals 1473*e*2 of the connector 1473*e* is released. Thereafter, contact between the earth terminals 1435*d* of the ID chip 1435 and the apparatus main-body earth terminals 1473*e*5 of the positioning pins 1473*e*3 (the connector 1473*e*) is released (separated). Specifically, in the connector 1473*e*, contact start positions of the apparatus main-body earth terminals 1473*e*5 are positioned closer to the ID chip 1435 side relative to the four apparatus main-body terminals 1473*e*2.

With this configuration, in the attachment operation of the toner container, contact between the metallic pads 35*a* and the apparatus main-body terminals 1473*e*2 is started always in a state in which the ID chip 1435 is connected to earth. Further, in the detachment operation of the toner container, separation (release of contact) between the metallic pads 35*a* and the apparatus main-body terminals 1473*e*2 is started always in a state in which the ID chip 1435 is connected to earth. Therefore, an electric circuit on the ID chip 1435 side is prevented from being not connected to earth and being in an electrically floating state, so that the ID chip 1435 is less likely to be electrically damaged.

Further, similarly to a relation between the ID chip of the above described first embodiment and the ID chip of the above described third embodiment, it is possible to replace the ID chip 1435 illustrated in FIG. 14 with the ID chip 1535 illustrated in FIG. 15. More specifically, referring to FIG. 15, in the ID chip 1535, the metallic terminal 1535*d* (earth terminal) for grounding is provided in an inner diameter portion and a periphery of the positioning hole 1535*b*11 serving as one of holes. Of course, the sliding improving member 200 is arranged by being attached to a back surface 1535*ba* of a substrate 1535*b* of the ID chip 1535 excluding the information storage unit 35*c* with the adhesive member 201.

With this configuration, in the attachment operation of the toner container, the earth terminal 1535*d* of the ID chip 1535 comes in contact with the apparatus main-body earth terminals 1473*e*5 of the positioning pins 1473*e*3 (the connector 1473*e*). Thereafter, the four metallic pads 35*a* of the ID chip 1535 start to come in contact with the four apparatus main-body terminals 1473*e*2 of the connector 1473*e*. In other words, in the detachment operation of the toner container, contact between the four metallic pads 35*a* of the ID chip 1535 and the four apparatus main-body terminals 1473*e*2 of the connector 1473*e* is released. Thereafter, contact between the earth terminal 1535*d* of the ID chip 1535 and the apparatus main-body earth terminals 1473*e*5 of the positioning pins 1473*e*3 (the connector 1473*e*) is released (separated). Specifically, in the connector 1473*e*, contact start positions of the apparatus main-body earth terminals 1473*e*5 are positioned closer to the ID chip 1535 side relative to the four apparatus main-body terminals 1473*e*2.

With this configuration, in the attachment operation of the toner container, contact between the metallic pads 35*a* and the apparatus main-body terminals 1473*e*2 is started always in a state in which the ID chip 1535 is connected to earth. Further, in the detachment operation of the toner container, separation (release of contact) between the metallic pads 35*a* and the apparatus main-body terminals 1473*e*2 is started always in a state in which the ID chip 1535 is connected to earth. Therefore, an electric circuit on the ID chip 1535 side is prevented from being not connected to earth and being in an electrically floating state, so that the ID chip 1535 is less likely to be electrically damaged.

Even in the sixth embodiment, the contact-type ID chips 1435 and 1535 are held on the holding portion 34*k* so as to be able to move on a virtual plane approximately perpendicular to the moving direction in which the metallic pads 35*a* approach and come in contact with the apparatus main-body terminals 1473*e*2. Therefore, even when the contact-type ID chips 1435 and 1535 are installed in the toner container that is removably installed in the image forming apparatus main body, a contact failure caused by a positioning failure with respect to the apparatus main-body terminals 1473*e*2 of the connector 1473*e* of the image forming apparatus main body is less likely to occur.

In the sixth embodiment, the contact-type ID chips 1435 and 1535 (information storage devices) are installed in the toner container (removable device) that is removably installed in the image forming apparatus main body 100. Even in this case, the earth terminals 1435*d* and 1535*d* to be fitted to the apparatus main-body earth terminals 1473*e*5 provided on the positioning pins 1473*e*3 of the connector 1473*e* are provided on the notches 1435*b*1 and the hole 1535*b*11 formed on the substrates 1435*b* and 1535*b* of the ID chips 1435 and 1535. Therefore, the ID chips 1435 and 1535 are less likely to be electrically damaged.

Further, even in the sixth embodiment, the sliding improving member 200 is arranged on the back surface 1435*ba* of the substrate 1435*b* of the ID chip 1435 and the back surface 1535*ba* of the substrate 1535*b* of the ID chip 1535. Therefore, the slidability between the ID chips 1435 and 1535 (the substrates 1435*b* and 1535*b*) and the holding portion 34*k* (holder) is improved. As a result, it becomes possible to prevent the positioning pins 1473*e*3 (the protrusions) and the notches 1435*b*1 of the substrate 1435*b* or a hole 1535*b*21 of the substrate 1535*b* from being caught or locked together. Consequently, it becomes possible to accurately set the removable device including the ID chip 1435 or 1535 in the image forming apparatus main body, enabling to more reliably prevent occurrence of a communication failure.

In the above described embodiments, PET is used as the sliding improving member 200, and, because a surface resistance value of general PET is about $10^{17}$, static electricity is generated due to friction. The information storage unit 35*c* is arranged on the substrate of each of the ID chips; therefore, it may be possible that electrostatic breakdown occurs if large static electricity is applied due to friction of the sliding improving member 200.

Therefore, it is preferable to employ antistatic resin as the sliding improving member 200 arranged between each ID chip and the holder. As the antistatic resin, PET with a surface resistance value of about $10^{10}$ is used as the sliding improving member 200. Of course, other materials may be employed. Specifications of the antistatic resin differ from one manufacturer to another, so the surface resistance value is not limited to the above described values. If the antistatic resin as described above is used as the sliding improving member 200, even when each ID chip and each holder slide against each other, it becomes possible to prevent static electricity from being generated, enabling to prevent electrostatic breakdown of each substrate beforehand.

If there is no space for arranging the sliding improving member 200 molded with thin PET, bend due to oscillation or the like may occur and stable arrangement may become impossible. To cope with this, in the above described embodiments, the sliding improving member 200 is attached to each substrate with the adhesive member 201, such as a double-stick tape, so that it is possible to prevent displacement of the sliding improving member 200.

The sliding improving member 200 may be attached to the holder side. However, if the sliding improving member 200 is attached to the holder, a contact area size of the holder is small and multiple attachment portions are needed, so that operability may be reduced. On the contrary, if the sliding improving member 200 is attached to the substrate of the ID chip, an area size is greater than that of the holder and multiple attachment portions are not needed and so single attachment is adequate, so that operability may be improved, which is preferable. Namely, because the holder such as a supporting part has only a small space, by attaching the sliding improving member 200 to the back side of the substrate with the adhesive member 201, it becomes possible to stably perform arrangement and easily perform attachment operations. Further, by interposing the adhesive member 201 between the back side of the substrate and the sliding improving member 200, static electricity is less likely to flow from the sliding improving member 200 to the substrate of each ID chip, which is preferable in terms of prevention of electrostatic breakdown.

Seventh Embodiment

With reference to FIG. 16, FIG. 17, and FIGS. 18A and 18B, a seventh embodiment of the present invention will be described in detail. In the seventh embodiment, a low frictional structure is configured by reducing a contact area size of the holder that comes in contact with the substrate.

In the seventh embodiment, an ID chip (information storage device) is the ID chip 535 described in the fifth embodiment, and the ID chip 535 is movably inserted in the recess 635Aa formed on the end surface 634Ya of the cap 634Y facing the attachment section. Further, the ID chip 535 is held on the faceplate 634*p* so as to be able to move in the XZ direction (see FIGS. 11A and 11B). However, in the seventh embodiment, the ID chip 535 does not include the sliding improving member 200.

In the recess 635Aa, the multiple supporting parts 634*q* are provided, which serve as the holders that come in surface contact with only a part of the ID chip 535. In a state in which the ID chip 535 is movably inserted in the recess 635Aa of the cap 634Y, the faceplate 634*p* for preventing the ID chip 535 from coming off from the recess 635Aa is installed. In the seventh embodiment, the ID chip 535 is movably inserted in the recess 635Aa, so before the positioning pin 573*e*23 provided on the connector main body 573*e*21 is inserted in the hole 535*b*21 formed on the substrate, a lower edge of the ID chip 535 is placed on a lower surface 635Ab of the recess 635Aa. In this state, if the back surface 535*ba* of the ID chip 535, which serves as a contact surface of the substrate 535*b* that comes in contact with the supporting parts 634*q*, comes in contact with the supporting parts 634*q*, resistance may be increased according to a contact area size, and this may be a cause to reduce the slidability of the ID chip 535.

Therefore, in the seventh embodiment, an area size of a supporting part 634*q*1 located in the moving direction, in which the ID chip 535 moves when the positioning pin 573*e*23 is inserted in the hole 535*b*21 formed on the substrate, is reduced. Specifically, the moving direction in the seventh embodiment is the Z direction indicating upward in the drawing. Therefore, a Z-directional width of the supporting part 634*q*1 located in the Z direction is reduced as compared with the supporting parts 634*q* of the fifth embodiment.

Therefore, when the positioning pin 573*e*23 is inserted in the hole 535*b*21 formed on the substrate, a contact area size between the supporting part 634*q*1 and the back surface 535*ba* of the ID chip 535 is reduced, so that contact resistance is reduced and the slidability is improved. Consequently, it becomes possible to prevent the positioning pin 573*e*23 (protrusion) and the hole 535*b*21 of the substrate 535*b* from being caught or locked together. Further, even in the seventh embodiment, it becomes possible to accurately set a toner container including the ID chip 535 in the image forming apparatus main body, enabling to more reliably prevent occurrence of a communication failure.

Figure 16:
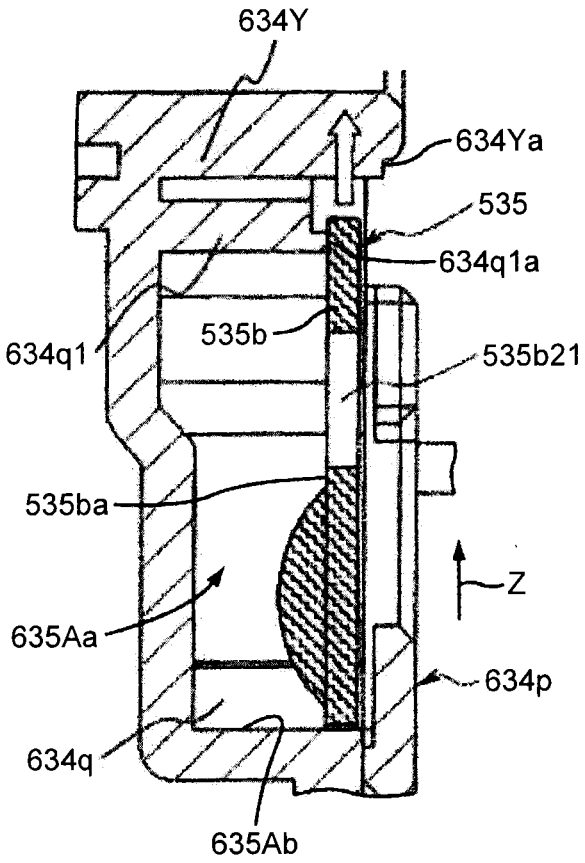
FIG. 16 is a partial enlarged cross-sectional view illustrating configurations of an information storage device and a holding portion according to a seventh embodiment.
Figure 17:
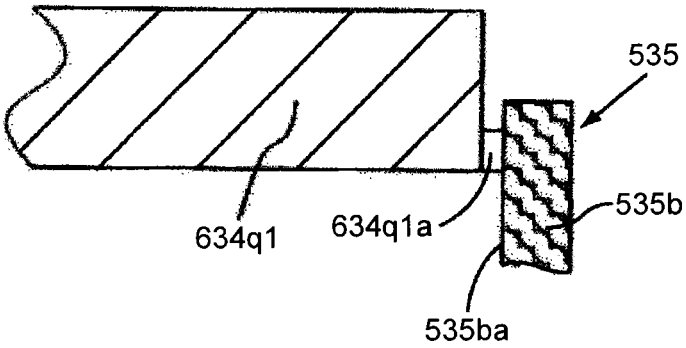
FIG. 17 is an enlarged view of a contact portion between the information storage device and the holding portion.
Figure 18A:
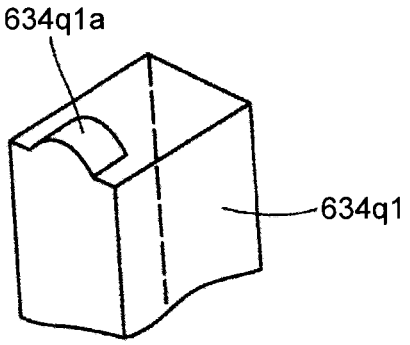
FIGS. 18A and 18B are enlarged views illustrating a surface shape of a contact surface between the holding portion and the substrate.
Figure 18B:
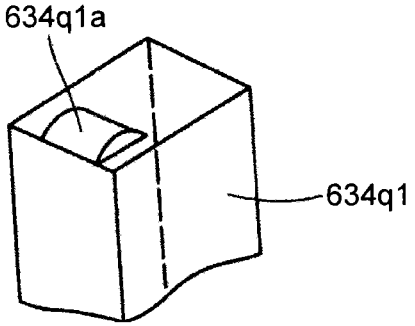

A surface shape of a contact surface 634*q*1*a* of the supporting part 634*q*1 that comes in contact with the back surface 535*ba* of the ID chip 535 may be a flat surface as illustrated in FIG. 16 and FIG. 17, or may be a circular arc shape as illustrated in FIGS. 18A and 18B.

If the surface shape of the contact surface 634*q*1*a* of the supporting part 634*q*1 is formed in a circular arc shape as described above, the ID chip 535 and the contact surface 634*q*1*a* (the supporting part 634*q*1) come in line contact with each other, so that a contact area size is reduced. Therefore, contact resistance between the supporting part 634*q*1 and the ID chip 535 is reduced and the slidability is improved, so that it becomes possible to accurately set the toner container including the ID chip 535 in the image forming apparatus main body, enabling to more reliably prevent occurrence of a communication failure.

Eighth Embodiment

Figure 19:
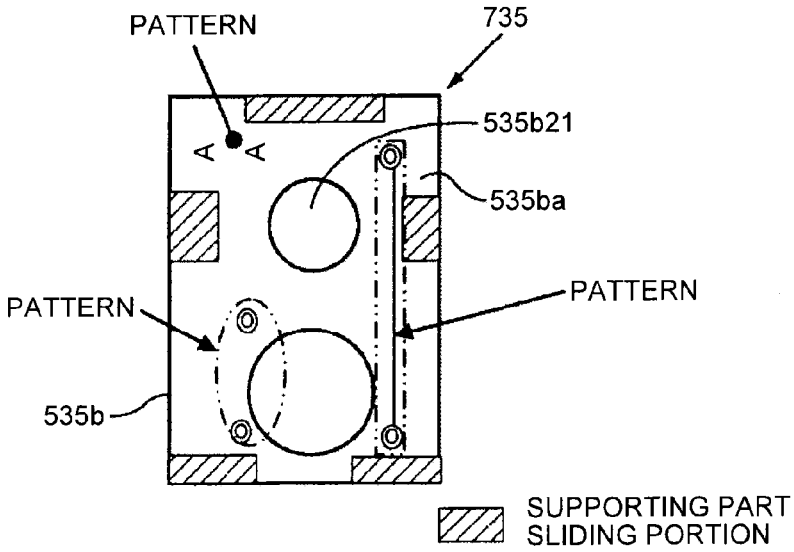
FIG. 19 is a plan view illustrating a configuration of an information storage device according to an eighth embodiment.

With reference to FIG. 19, an eighth embodiment of the present invention will be described in detail. In the eighth embodiment, as a low frictional structure, at least a pattern is not arranged in a portion of the substrate in which the substrate of the ID chip and the holder come in contact with each other.

A basic configuration of an ID chip 735 according to the eighth embodiment is the same as the ID chip 535 of the seventh embodiment; however, a pattern of the substrate 535*b* is formed in an area other than areas indicated by hatched lines in FIG. 19 that come in contact with the supporting parts 634*q* serving as the holders. Namely, wiring or a pattern of the substrate 535*b* is formed so as not to be exposed in the contact area of the supporting parts 634*q* indicated by hatched lines in FIG. 19. The pattern described herein indicates a pattern such as wiring or a contact point enclosed by a two-dot chain line, and a pattern such as signs indicated by alphabets AA in FIG. 19.

With this configuration, the supporting parts 634*q* and wiring or a pattern of the substrate 535*b* do not come in contact with each other, so that contact resistance between the substrate 535*b* and the supporting parts 634*q* is reduced and the slidability is improved. Therefore, it becomes possible to prevent the positioning pin 573*e*23 (protrusion) and the hole 535*b*21 of the substrate 535*b* from being caught or locked together. Further, even in the eighth embodiment, it becomes possible to accurately set the toner container including the ID chip 535 in the image forming apparatus main body, enabling to more reliably prevent occurrence of a communication failure.

Ninth Embodiment

Figure 20:
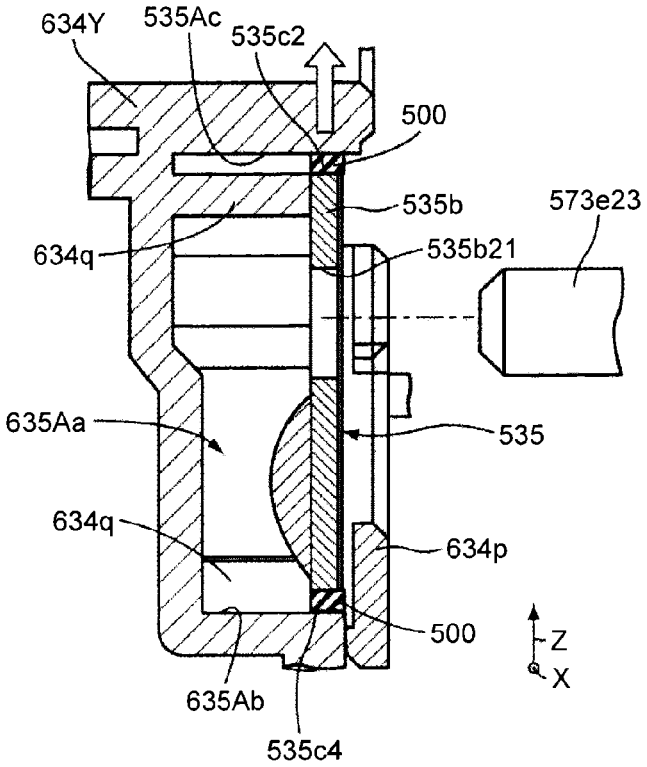
FIG. 20 is a partial enlarged cross-sectional view illustrating configurations of an information storage device and a holding portion according to a ninth embodiment.
Figure 21:
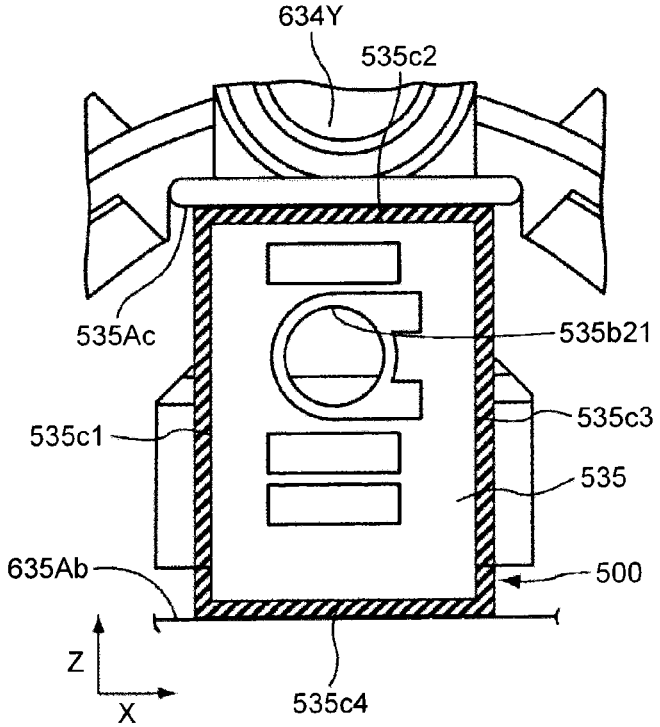
FIG. 21 is an enlarged view for explaining arrangement of an elastic body according to the ninth embodiment.

With reference to FIG. 20 and FIG. 21, a ninth embodiment of the present invention will be described in detail. In the ninth embodiment, an elastic body is provided in a contact portion between the holder and the substrate.

In the ninth embodiment, an ID chip (information storage device) is the ID chip 535 described in the fifth embodiment, and the ID chip 535 is movably inserted and held, with a degree of freedom, in the recess 635Aa formed on the end surface 634Ya of the cap 634Y facing the attachment section. The ID chip 535 serving as a substrate is held on the faceplate 634*p* so as to be able to move in the XZ direction (see FIGS. 11A and 11B). However, in the ninth embodiment, the ID chip 535 does not include the sliding improving member 200.

At the time of setting to the image forming apparatus, the hole 535*b*21 formed on the ID chip 535 is picked up by the taper of the positioning pin 573*e*23, which is provided on the connector main body 573*e*21 and which serves as an apparatus main-body protrusion, and the ID chip 535 moves to the upper side as if it is scooped up. In this case, the ID chip 535 is pushed against the supporting parts 634*q* and moves to the upper side; therefore, if the slidability between the ID chip 535 and the supporting parts 634*q* is low, the hole 535*b*21 of the ID chip 535 may be caught in the middle of the taper of the positioning pin 573*e*23.

Therefore, in the ninth embodiment, as illustrated in FIG. 20 and FIG. 21, an elastic body 500 is provided in a contact portion between the recess 635Aa and the ID chip 535, so that the position of the ID chip 535 in the recess 635Aa is always maintained while allowing movement in the XZ direction, and the movement amount of the ID chip 535 at the time of contacting the positioning pin 573*e*23 is reduced.

The elastic body 500 according to the ninth embodiment has a frame shape, and is arranged between four surfaces 535*c*1 to 535*c*4 of the ID chip 535 and the lower surface 635Ab and an upper surface 535Ac of the recess, which are portions of the holder facing the four surfaces and which serve as inner surfaces of the recess 635Aa. As the elastic body 500, a high-density micro-cell urethane sheet is used by taking into account surface slidability and elasticity maintainability. In view of this, even in the ninth embodiment, a low frictional structure is provided in a contact area between the substrate and the holder. The elastic body 500 may be fitted to the four surfaces 535*c*1 to 535*c*4 of the ID chip 535 so as to be arranged between the lower surface 635Ab and the upper surface 535Ac (inner surfaces). Alternatively, the elastic body 500 may be bonded or fitted to the lower surface 635Ab and the upper surface 535Ac (inner surfaces) in advance, and the ID chip 535 is attached to these surfaces so that the elastic body 500 is arranged between the four surfaces 535*c*1 to 535*c*4 and the lower and the upper surfaces 635Ab and 535Ac.

By providing the elastic body 500 in the contact portion between the recess 635Aa and the ID chip 535, the movement amount of the ID chip 535 at the time of contacting the positioning pin 573*e*23 is reduced, so that it becomes possible to prevent the hole 535*b*21 and the positioning pin 573*e*23 from being caught or locked together. Therefore, even in the ninth embodiment, it becomes possible to accurately set the toner container including the ID chip 535 in the image forming apparatus main body, enabling to more reliably prevent occurrence of a communication failure.

Figure 22:
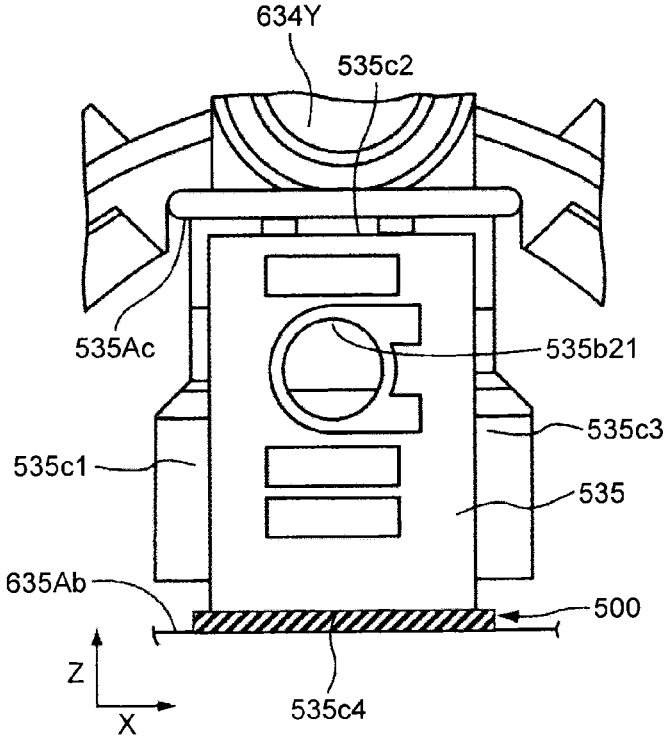
FIG. 22 is an enlarged view for explaining a mode in which the arrangement of the elastic body is changed.

In the ninth embodiment, the elastic body 500 is formed in a frame shape and is arranged between the four surfaces 535*c*1 to 535*c*4 of the ID chip 535 and the inner surfaces (the lower surface 635Ab and the upper surface 535Ac) of the recess 635Aa. However, before the elastic body 500 is attached or the positioning pin 573*e*23 is inserted in the hole 535*b*21, the ID chip 535 is presumably located in a lower position by being dragged by the gravity, that is, the surface 535*c*4 located in the lower edge is placed on the lower surface 635Ab of the recess 635Aa. In a positional relation with the positioning pin 573*e*23, if movement in at least the Z direction can be reduced, it becomes possible to reduce the frequency that the hole 535*b*21 of the ID chip 535 is caught or locked in the middle of the taper of the positioning pin 573*e*23. Therefore, it is preferable to arrange the elastic body 500 in, as illustrated in FIG. 22, at least a contact portion between the lower surface 635Ab of the recess 635Aa and a lower portion (the surface 535*c*4) of the ID chip 535. In FIG. 22, the elastic body 500 in a sheet shape is arranged between the lower surface 635Ab and the surface 535*c*4 of the ID chip 535.

With this configuration, by reducing the movement amount of the ID chip 535 at the time of contacting the positioning pin 573*e*23, it becomes possible to prevent the hole 535*b*21 and the positioning pin 573*e*23 from being caught or locked together. Therefore, even in the ninth embodiment, it becomes possible to accurately set the toner container including the ID chip 535 in the image forming apparatus main body, enabling to more reliably prevent occurrence of a communication failure. Further, as compared with a case of arranging the elastic body 500 formed in a frame shape, a use amount is reduced and processing costs can be reduced, so that it is also effective to suppress an increase in costs.

Figure 23:
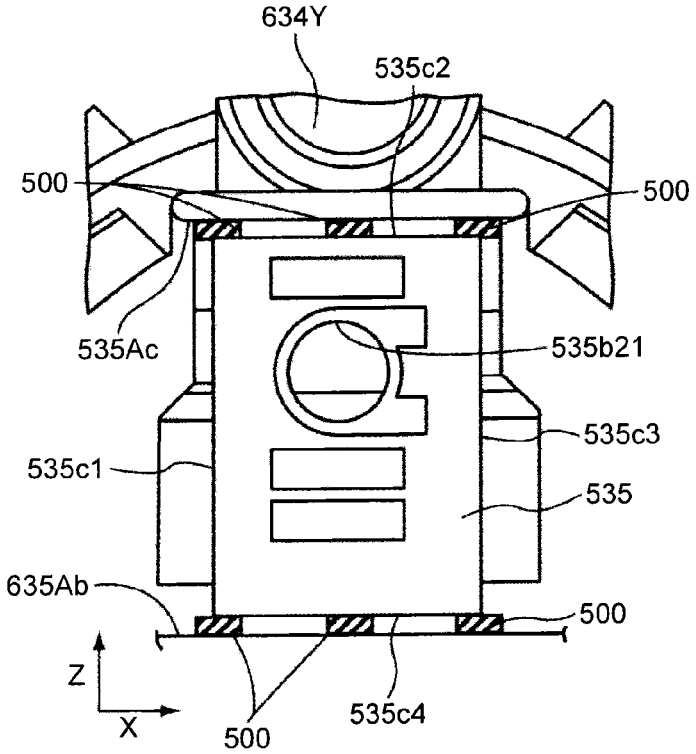
FIG. 23 is an enlarged view for explaining a mode in which the arrangement of the elastic body is changed.

In FIGS. 20 and 21, the elastic body 500 is formed in a frame shape and arranged between the four surfaces 535*c*1 to 535*c*4 of the ID chip 535 and the inner surfaces of the recess 635Aa. However, it may be possible to arrange the elastic body 500 in a sheet shape or a bar shape between the ID chip 535 and the inner surfaces of the recess 635Aa. Or, as illustrated in FIG. 23, it may be possible to separately arrange the elastic bodies 500 between the ID chip 535 and the lower and the upper surfaces 635Ab and 535Ac of the recess 635Aa. Incidentally, in the ninth embodiment, the lower surface 635Ab and the upper surface 535Ac of the recess 635Aa are illustrated as examples of the inner surfaces of the recess 635Aa; however, if the recess 635Aa has a side surface between the lower surface 635Ab and the upper surface 535Ac, the side surface is also included in the inner surfaces of the recess 635Aa.

Tenth Embodiment

Figure 24:
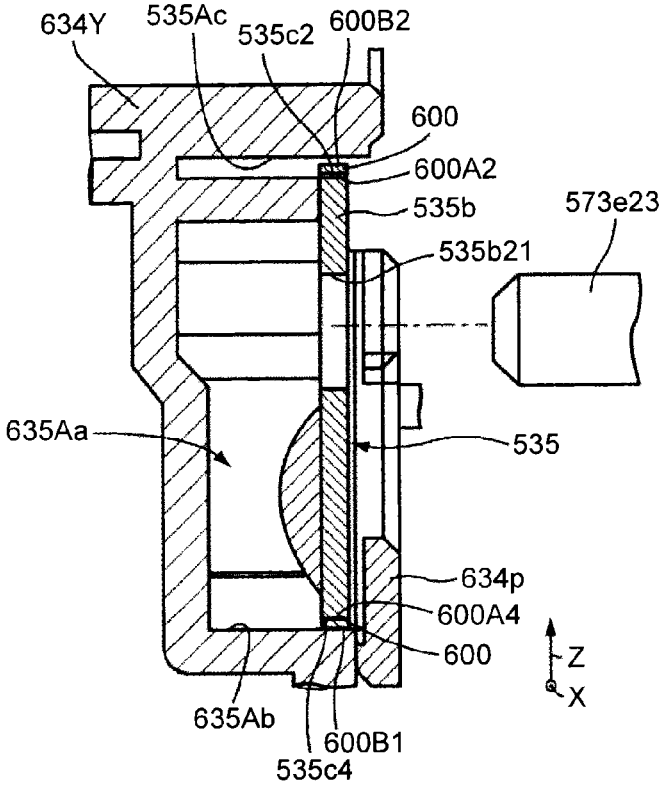
FIG. 24 is a partial enlarged cross-sectional view illustrating configurations of an information storage device and a holder according to a tenth embodiment.
Figure 25:
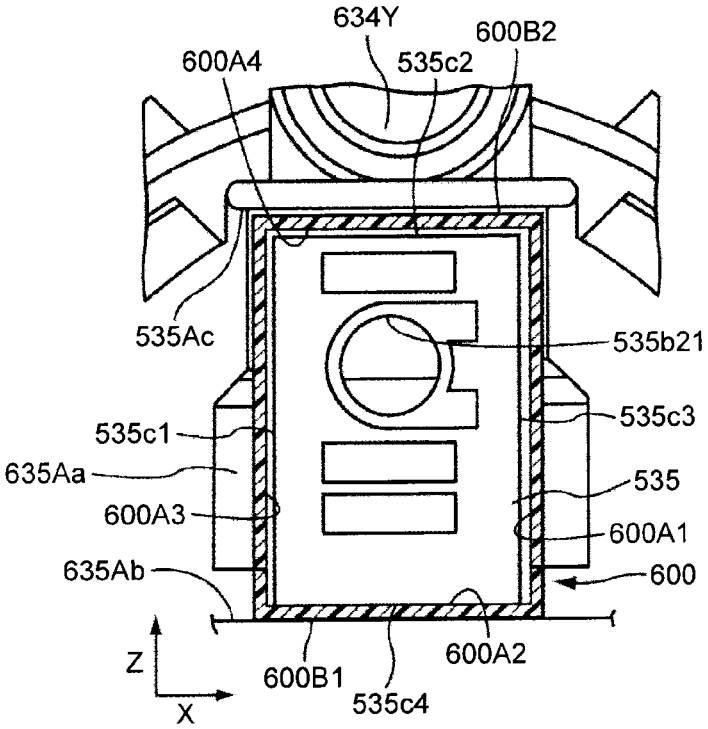
FIG. 25 is an enlarged view for explaining arrangement of the information storage device, the holder, and a cap receiving section according to the tenth embodiment.

With reference to FIG. 24 and FIG. 25, a tenth embodiment of the present invention will be described in detail. In the tenth embodiment, a low frictional structure is configured by enabling the holder to be displaced relative to at least one of the substrate and the removable device.

In the tenth embodiment, an ID chip (information storage device) is the ID chip 535 described in the fifth embodiment, and the ID chip 535 is movably inserted and held, with a degree of freedom, in the recess 635Aa formed on the end surface 634Ya of the cap 634Y facing the attachment section. The ID chip 535 serving as the substrate is held on the faceplate 634*p* so as to be able to move in the XZ direction (see FIGS. 11A and 11B). However, in the tenth embodiment, the ID chip 535 does not include the sliding improving member 200.

When the toner container is set in the image forming apparatus, the hole 535*b*21 formed on the ID chip 535 is picked up by the taper of the positioning pin 573*e*23, which is provided on the connector main body 573*e*21 and which serves as an apparatus main-body protrusion, and the ID chip 535 moves to the upper side as if it is scooped up. In this case, the ID chip 535 is pushed against the supporting parts 634*q* provided inside the recess 635Aa and moves to the upper side, and an irregular portion such as printed wiring is provided on the back surface 535*ba* that serves as a holder contact surface of the ID chip 535. Therefore, due to contact between the irregular portion and the supporting parts 634*q*, the slidability may be reduced and movement of the ID chip 535 may be disturbed. However, it is structurally difficult to eliminate the irregular portion of the back surface 535*ba* of the ID chip 535. If the movement of the ID chip 535 is disturbed, the hole 535*b*21 of the ID chip 535 may be caught in the middle of the taper of the positioning pin 573*e*23.

Therefore, in the tenth embodiment, a low frictional structure is made up of a holder 600 that can be displaced relative to the ID chip 535 and the recess 635Aa. The holder 600 has a frame shape, and is arranged between the four surfaces 535*c*1 to 535*c*4 (end surfaces serving as contact surfaces) of the ID chip 535 and the lower and the upper surfaces 635Ab and 535Ac, which are the inner surfaces of the recess 635Aa facing the four surfaces and which serve as contact surfaces. The holder 600 in a frame shape has an outer shape that is smaller than the inner size of the recess 635Aa, and is housed in the recess 635Aa so as to be able to move in the XZ direction. The holder 600 has an inner shape that is larger than the outer shape of the ID chip 535, and accommodates the ID chip 535 such that the ID chip 535 can move in the XZ direction. The entirety of the holder 600 is made up of a resin material with slidability. Therefore, four surfaces 600A1 to 600A4, which are inner surfaces of the holder 600 and which are surfaces facing the ID chip 535, and outer surfaces 600B1 and 600B2 of the holder 600, which are surfaces facing the lower and the upper surfaces 635Ab and 535Ac of the recess 635Aa have slidability. The holder 600 may be configured by attaching members with slidability to the four surfaces 600A1 to 600A4 and the outer surfaces 600B1 and 600B2, instead of configuring the entirety by using a resin material with slidability.

By interposing the holder 600 between the recess 635Aa and the ID chip 535, by forming a clearance with respect to the recess 635Aa and the ID chip 535, and by enabling the holder 600 to be displaced relative to the recess 635Aa and the ID chip 535, the degree of freedom of the recess 635Aa and the ID chip 535 increases. Therefore, even when the ID chip 535 and the hole 535*b*21 are caught together and movement of the ID chip 535 is disturbed, the holder 600 moves to cause movement with the ID chip 535, so that the ID chip 535 can move to an arbitrary position. Therefore, it becomes possible to prevent the hole 535*b*21 and the positioning pin 573*e*23 from being caught or locked together and to accurately set the toner container including the ID chip 535 in the image forming apparatus main body, enabling to more reliably prevent occurrence of a communication failure.

Further, the holder 600 is made up of a resin material with slidability; therefore, the holder 600 can move relative to the recess 635Aa even with a weak force applied from the ID chip 535. Namely, movement relative to the recess 635Aa becomes easy, so that it becomes possible to prevent the hole 535*b*21 and the positioning pin 573*e*23 from being caught or locked together.

Eleventh Embodiment

Figure 26:
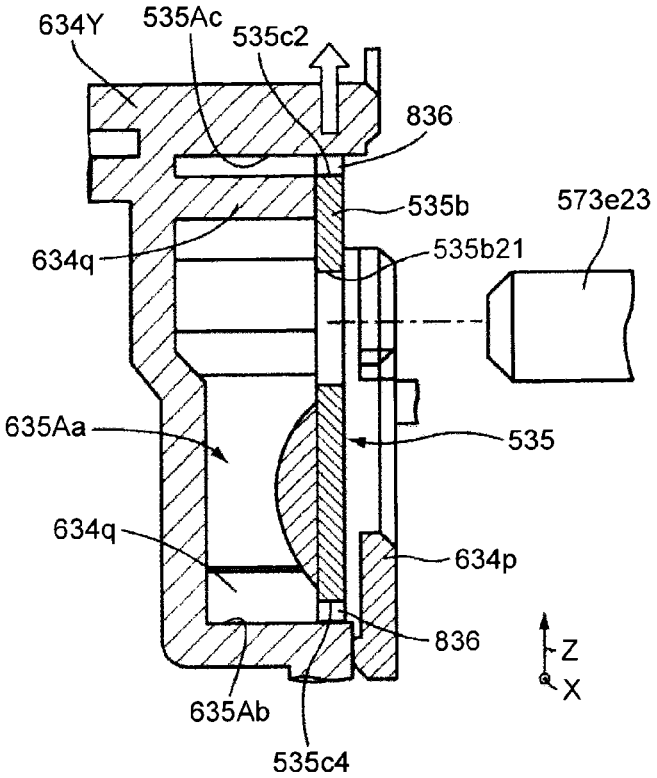
FIG. 26 is a partial enlarged cross-sectional view illustrating configurations of an information storage device and a holder according to an eleventh embodiment.
Figure 27:
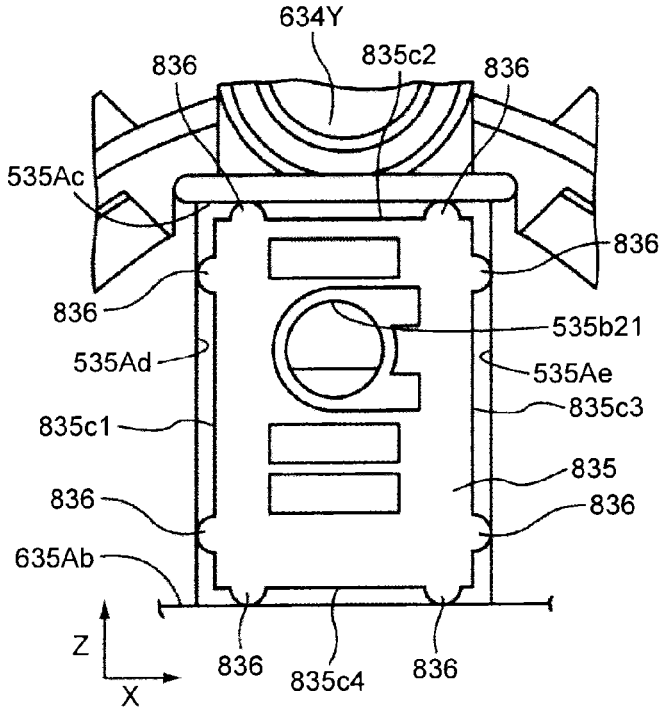
FIG. 27 is an enlarged view for explaining arrangement of the information storage device, the holder, and a cap receiving section according to the eleventh embodiment.

With reference to FIG. 26 and FIG. 27, an eleventh embodiment of the present invention will be described in detail. In the seventh embodiment described with reference to FIG. 16 to FIG. 18B, a contact area size of the holder that comes in contact with the ID chip serving as the substrate is reduced. In contrast, in the eleventh embodiment, a low frictional structure is configured by reducing a contact area size of the substrate that comes in contact with the holder.

A basic configuration of an ID chip 835 according to the eleventh embodiment is the same as the ID chip 535 of the seventh embodiment; however, multiple protrusions 836 protruding outward from each of four surfaces 835*c*1 to 835*c*4 serving as end surfaces of the ID chip 835 are provided on the four surfaces. A protruding direction of each of the protrusions 836 is a direction toward an inner surface of the recess 635Aa facing each of the surfaces 835*c*1 to 835*c*4. Namely, the ID chip 835 according to the embodiment includes the multiple protrusions 836 protruding toward the lower surface 635Ab, the upper surface 535Ac, and left and right side surfaces 535Ad and 535Ae, which serve as the inner surfaces of the recess 635Aa, so that each of the end surfaces of the ID chip 835 has an irregular form. Therefore, in the ID chip 835 according to the eleventh embodiment, the widths of contact portions that come in contact with the inner surfaces of the recess 635Aa are reduced in the vertical direction including the Z direction in the drawing and in the width direction including the X direction in the drawing, as compared with a configuration without the protrusions 836.

Therefore, when the positioning pin 573*e*23 is inserted in the hole 535*b*21 formed on the substrate, contact area sizes between the four surfaces 835*c*1 to 835*c*4 serving as the end surfaces of the ID chip 835 and the lower surface 635Ab, the upper surface 535Ac, and the left and right side surfaces 535Ad and 535Ae of the recess 635Aa are reduced, so that contact resistance is reduced and the slidability is improved. Consequently, it becomes possible to prevent the positioning pin 573*e*23 (protrusion) and the hole 535*b*21 of the substrate 535*b* from being caught or locked together. Further, even in the eleventh embodiment, it becomes possible to accurately set the toner container including the ID chip 835 in the image forming apparatus main body, enabling to more reliably prevent occurrence of a communication failure.

Figure 28:
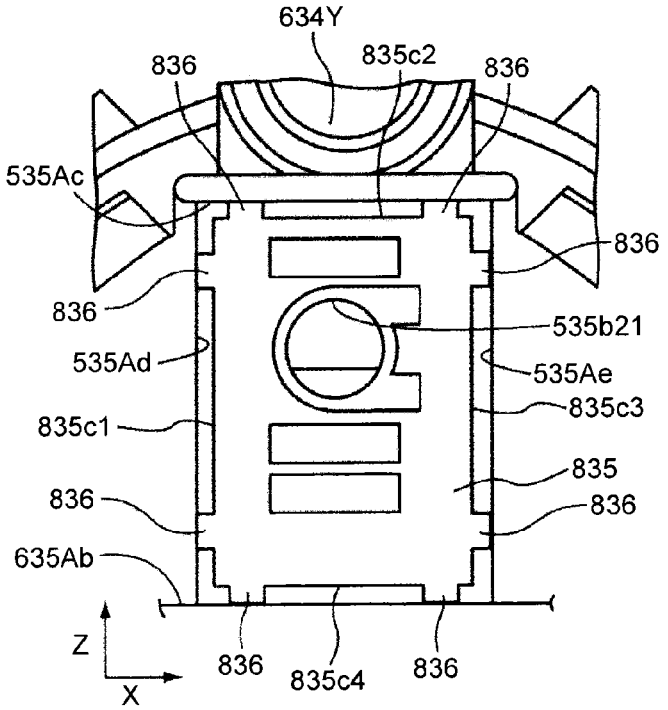
FIG. 28 is an enlarged view illustrating a modification of the eleventh embodiment in which protrusions are provided on a substrate.

As shapes of the protrusions 836, circular arc shapes or, as illustrated in FIG. 28, flat planes may be employed. If the protrusions 836 are formed in circular arc shapes, the ID chip 835 comes in line contact with the lower surface 635Ab, the upper surface 535Ac, and the left and right side surfaces 535Ad and 535Ae of the recess 635Aa, so that contact area sizes are reduced. Therefore, contact resistance between the lower surface 635Ab, the upper surface 535Ac, the left and right side surfaces 535Ad and 535Ae and the ID chip 835 is reduced and the slidability is improved. Further, it becomes possible to accurately set the toner container including the ID chip 835 in the image forming apparatus main body, enabling to more reliably prevent occurrence of a communication failure. Furthermore, if, as illustrated in FIG. 28, the protrusions 836 are formed in square shapes with the contact surfaces formed as flat planes, processing labors can be reduced as compared with the case of the circular arch shapes, which is preferable in terms of cost reduction.

Twelfth Embodiment

Figure 29:
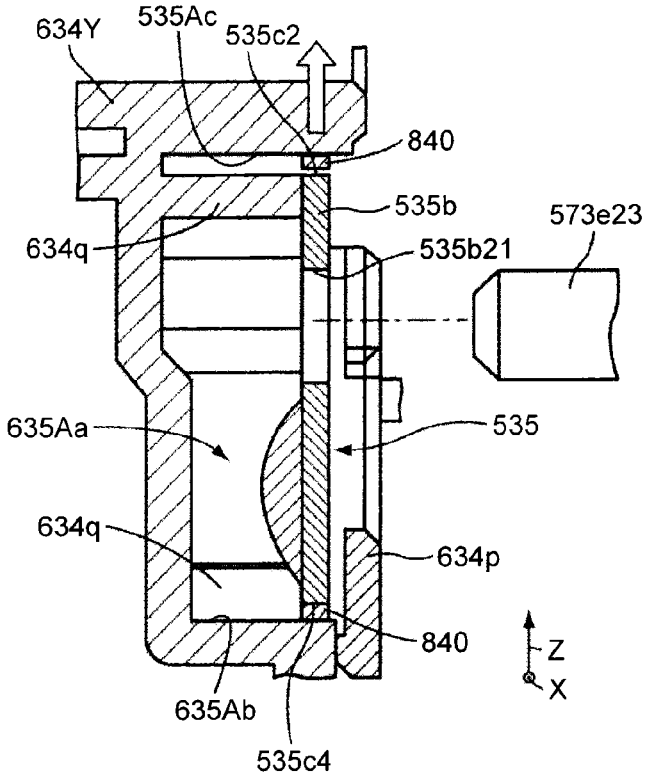
FIG. 29 is a partial enlarged cross-sectional view illustrating configurations of an information storage device and a holder according to a twelfth embodiment.
Figure 30:
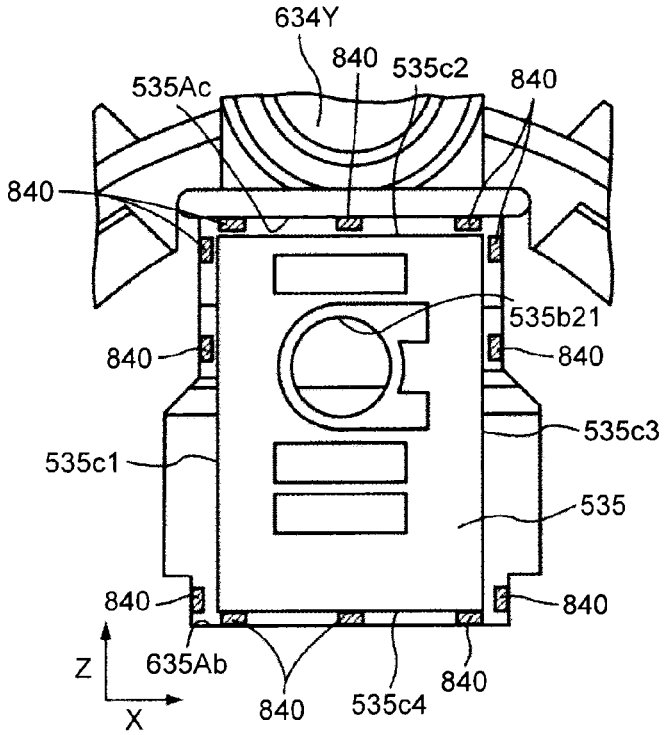
FIG. 30 is an enlarged view for explaining arrangement of the information storage device, the holder, and a cap receiving section according to the twelfth embodiment.

With reference to FIG. 29 and FIG. 30, a twelfth embodiment of the present invention will be described in detail. In the seventh embodiment described with reference to FIG. 16 to FIG. 18B, a contact area size between the back surface 535*ba* of the ID chip 535 and the supporting part 634*q*1 of the recess 635Aa serving as the holder that comes in contact with the ID chip 535 is reduced. In contrast, in the twelfth embodiment, a low frictional structure is configured by reducing contact area sizes between the ID chip 535 and the inner surfaces of the recess 635Aa serving as the holder.

In the twelfth embodiment, an ID chip (information storage device) is the ID chip 535 described in the fifth embodiment, and the ID chip 535 is movably inserted and held, with a degree of freedom, in the recess 635Aa formed on the end surface 634Ya of the cap 634Y facing the attachment section. In the twelfth embodiment, the ID chip 535 serving as the substrate does not include the sliding improving member 200.

On the lower surface 635Ab, the upper surface 535Ac, and the left and right side surfaces 535Ad and 535Ae, which are the inner surfaces of the recess 635Aa facing the four surfaces 535*c*1 to 535*c*4 of the ID chip 535, multiple protrusions 840 protruding toward the four surfaces 535*c*1 to 535*c*4 are provided. Each of the protrusions 840 has a square shape with a size that allows a clearance to be formed with respect to the lower surface 635Ab, the upper surface 535Ac, and the left and right side surfaces 535Ad and 535Ae, and contact portions with respect to the four surfaces 535*c*1 to 535*c*4 are formed as flat planes. In general, the ID chip 535 is in a state of being placed on the protrusions 840 provided on the lower surface 635Ab by its own weight.

Specifically, the lower surface 635Ab, the upper surface 535Ac, and the left and right side surfaces 535Ad and 535Ae, which are the inner surfaces of the recess 635Aa according to the twelfth embodiment, include the multiple protrusions 840 protruding toward the four surfaces 535*c*1 to 535*c*4 of the ID chip 535 so that the inner surfaces of the recess 635Aa have irregular forms. Therefore, contact widths of the inner surfaces of the recess 635Aa according to the twelfth embodiment with respect to the ID chip 535 are reduced in the vertical direction including the Z direction in the drawing and in the width direction including the X direction in the drawing, as compared with a configuration without the protrusions 840.

Therefore, when the positioning pin 573*e*23 is inserted in the hole 535*b*21 formed on the substrate 535*b*, contact area sizes between the four surfaces 535*c*1 to 535*c*4 serving as the end surfaces of the ID chip 535 and the lower surface 635Ab, the upper surface 535Ac, and the left and right side surfaces 535Ad and 535Ae of the recess 635Aa are reduced, so that contact resistance is reduced and the slidability is improved. Consequently, it becomes possible to prevent the positioning pin 573*e*23 (protrusion) and the hole 535*b* of the substrate 535*b* from being caught or locked together. Further, even in the twelfth embodiment, it becomes possible to accurately set the toner container including the ID chip 535 in the image forming apparatus main body, enabling to more reliably prevent occurrence of a communication failure.

Figure 31:
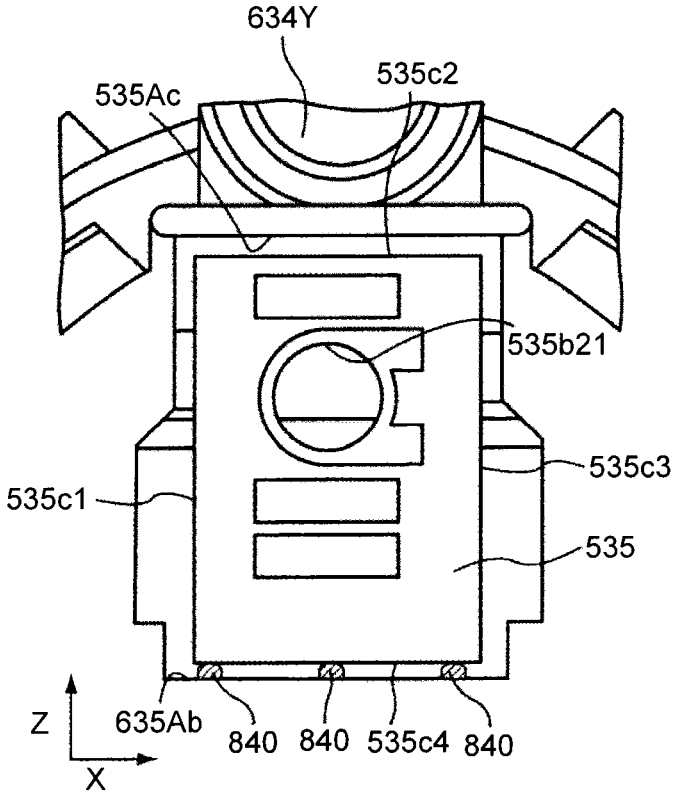
FIG. 31 is an enlarged view illustrating a modification of the twelfth embodiment in which protrusions are provided on the holder.

Surface shapes of the contact surfaces of the protrusions 840 provided on the lower surface 635Ab, the upper surface 535Ac, and the left and right side surfaces 535Ad and 535Ae of the recess 635Aa that come in contact with the four surfaces 535*c*1 to 535*c*4 of the ID chip 535 may be flat planes as illustrated in FIG. 29 and FIG. 30, or may be circular arc shapes as illustrated in FIG. 31.

If the surface shapes of the contact surfaces of the protrusions 840 are formed in circular arc shapes, the four surfaces 535*c*1 to 535*c*4 of the ID chip 535 come in line contact with the protrusions 840, so that contact area sizes are reduced. Therefore, contact resistance between the protrusions 840 and the ID chip 535 is reduced and the slidability is improved, and it becomes possible to accurately set the toner container including the ID chip 535 in the image forming apparatus main body, enabling to more reliably prevent occurrence of a communication failure.

Incidentally, it is sufficient that the protrusions 840 provided on the recess 635Aa are arranged in a portion facing at least one of the four surfaces 535*c*1 to 535*c*4 of the ID chip 535, and it is not necessary to provide the protrusions 840 on all of the four surfaces 535*c*1 to 535*c*4 as in the twelfth embodiment.

Each of the removable devices is removably installable in the image forming apparatus main body at the time of replacement or maintenance. Therefore, if the apparatus main-body protrusions and the guide of the substrate of the ID chip are caught together and damaged once, it becomes difficult to set other removable devices again and it takes time to replace or repair components including the apparatus main-body protrusions. However, as in the above described embodiments, by arranging the sliding improving member 200 as a low frictional structure in the contact area between the substrate and the holder (the supporting parts 634*q*, 634*q*1, 600, 635Aa) or by preventing the supporting part 634*q*1, wiring, or circuit patterns from being arranged in the contact area, it becomes possible to prevent the positioning pin (protrusion) and the guide of the substrate from being caught or locked together. Therefore, it is also possible to reduce a time to replace or repair the removable device.

In the first to fifth embodiments, only toner (one-component developer) is stored in the toner container (denoted by the reference signs 32Y, 32M, 32C, 32K, or the like) serving as a developer container. However, it is possible to store two-component developer in a toner container (developer container) of an image forming apparatus that appropriately supplies two-component developer formed of toner and carrier to a developing device. Further, it may be possible to store developer, such as wet toner or ink, to an image forming apparatus that appropriately supplies wet toner or ink to a developing device. Furthermore, in either case, the same advantageous effects as those of the above described embodiments can be obtained.

In the above described first to fifth embodiments, part or all of the image forming units 6Y, 6M, 6C, and 6K may be formed as process cartridges. Even in this case, the same advantageous effects as those of the above described embodiments can be obtained.

Further, in the above described embodiments, the multiple metallic pads 35*a* are aligned in the vertical direction on the substrate (denoted by 35*b*, 535*b*, or the like) of the ID chip (denoted by 35, 535, 735, 835, or the like) such that the positions in the longitudinal direction are not deviated. On the contrary, it may be possible to arrange the multiple metallic pads 35*a* in the vertical direction on the substrate of each ID chip such that the positions in the longitudinal directions alternately shifted in a zigzag manner. In this case, the multiple apparatus main-body terminals (denoted by 73*e*2, 573*e*2, or the like) in the connector (denoted by the reference signs 73*e*, 573*e*, or the like) are also arranged in a zigzag manner in accordance with the metallic pads 35*a* that are arranged in a zigzag manner. Even in this case, the same advantageous effects as those of the above described embodiments can be obtained.

Furthermore, in the above described embodiments, the present invention is applied to the ID chip (information storage device) installed in the toner container 32Y (developer container) or the like serving as the removable device that is removably installed in image forming apparatus main body 100 or the like. However, application of the present invention is not limited to the above, and the present invention may be applied in the same manner as in the above described embodiments to other removable devices removably installed in the image forming apparatus main body 100 or the like as long as information storage devices are installed in the removable devices. For example, in the image forming apparatus main body 100 illustrated in FIG. 1, even when an information storage device is installed in the process cartridges 6Y, 6M, 6C, and 6K, a fixing device 20, the intermediate transfer unit 15, or the like serving as the removable device, the present invention may be applied to each of the units and devices in the same manner as in the above described embodiments. Even in this case, the same advantageous effects as those of the above described embodiments can be obtained.

Moreover, the low frictional structure may be configured by using multiple low frictional structures described in the embodiments in combination. For example, if the sliding improving member 200 described in the first embodiment is used in combination with the other embodiments, it becomes possible to more reduce contact resistance between each ID chip and each holder and improve the slidability as compared with a case in which the low frictional structure of each embodiment is used as an independent configuration. Therefore, it becomes possible to prevent the positioning pin (protrusion) and the hole of the substrate from being caught or locked together, and it becomes possible to accurately set the toner container including each ID chip in the image forming apparatus main body, enabling to more reliably prevent occurrence of a communication failure.

According to an embodiment of the present invention, it is possible to provide a removable device and an image forming apparatus including a substrate of an information storage device, which enables communication between the image forming apparatus main body and the removable device and on which a guide is provided; a holder that holds the substrate of the information storage device such that the substrate is able to move, when the removable device approaches an apparatus main-body terminal provided in an image forming apparatus main body, on a virtual plane intersecting with a moving direction in which the removable device approaches the apparatus main-body terminal; and a low frictional structure arranged in a contact area between the substrate and the holder. Therefore, it is possible to reduce contact resistance between the substrate and the holder and improve slidability, enabling to prevent an apparatus main-body protrusion and the guide of the substrate from being caught together and to perform reliable attachment to a normal position while preventing a communication failure.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A removable device, removably attachable to an image forming apparatus, the removable device comprising:

a reservoir to hold an image forming substance;

an information storage device including:

an information storage unit that stores therein information to be communicated between the image forming apparatus and the removable device;

a terminal to be contacted with an apparatus terminal provided on the image forming apparatus, for communicating information with the image forming apparatus; and a substrate that holds the information storage unit and the terminal and that includes a guide to be fitted to a protrusion provided on the image forming apparatus;

a holder that holds the substrate of the information storage device such that the substrate is able to move, relative to the removable device, when the removable device approaches the apparatus terminal provided on the image forming apparatus, on a virtual plane intersecting with a moving direction of the removable device; and a sliding structure arranged on a contact area between the substrate and the holder, the sliding structure having a coefficient of friction which is lower than a coefficient of friction of the substrate and lower than a coefficient of friction of the holder, wherein:

the sliding structure includes a sliding improving member that is arranged between the substrate and the holder, and the sliding improving member includes polyethylene terephthalate or antistatic resin.

2. The removable device according to claim 1, wherein the guide provided on the substrate is one of a notch and an opening and includes an earth terminal that is to contact an apparatus earth terminal provided on the protrusion of the image forming apparatus, and the holder holds the substrate of the information storage device such that the substrate is able to move on the virtual plane intersecting with the moving direction along which the earth terminal is to approach and to be contacted with the apparatus earth terminal.

3. The removable device according to claim 1, wherein the holder is a supporting part that is located in a recess provided on a surface facing an attachment section provided on the image forming apparatus, and that holds the substrate of the information storage device such that the substrate is able to move on the virtual plane.

4. The removable device according to claim 1, wherein the sliding improving member is attached to one of the substrate and the holder with an adhesive member.

5. The removable device according to claim 1, wherein the sliding structure is configured such that a contact area size of the holder and the substrate is less than an area of the substrate.

6. The removable device according to claim 5, wherein a surface shape of the holder to be contacted with the substrate is a circular arc shape.

7. The removable device according to claim 1, wherein the sliding structure is configured such that at least a pattern is not arranged on a portion of the substrate in which the substrate and the holder are contacted with each other.

8. The removable device according to claim 1, further comprising an elastic body on a contact portion between the holder and the substrate.

9. The removable device according to claim 8, wherein the elastic body is arranged on a portion of the holder to be contacted with the substrate.

10. The removable device according to claim 8, wherein the elastic body is arranged on a contact portion between the holder and a lower portion of the substrate.

11. The removable device according to claim 1, wherein the sliding structure is configured such that a contact area size of the substrate and the holder is less than an area of the holder.

12. The removable device according to claim 1, wherein the removable device is removably installable in a main body of the image forming apparatus and is one of a toner cartridge accommodating the substance which is toner, a process cartridge accommodating the substance which is toner, and an ink cartridge accommodating the substance which is ink.

13. An image forming apparatus comprising the removable device according to claim 1.

14. The removable device according to claim 1, wherein:

the sliding improving member includes polyethylene terephthalate.

15. The removable device according to claim 1, wherein:

the sliding improving member includes antistatic resin.

16. A removable device, removably attachable to an image forming apparatus, the removable device comprising:

a reservoir to hold an image forming substance;

an information storage device including:

an information storage unit that stores therein information to be communicated between the image forming apparatus and the removable device;

a terminal to be contacted with an apparatus terminal provided on the image forming apparatus, for communicating information with the image forming apparatus; and a substrate that holds the information storage unit and the terminal and that includes a guide to be fitted to a protrusion provided on the image forming apparatus;

a holder that holds the substrate of the information storage device such that the substrate is able to move, relative to the removable device, when the removable device approaches the apparatus terminal provided on the image forming apparatus, on a virtual plane intersecting with a moving direction of the removable device; and a sliding structure arranged on a contact area between the substrate and the holder, the sliding structure having a coefficient of friction which is lower than a coefficient of friction of the substrate and lower than a coefficient of friction of the holder, wherein:

the sliding structure is configured by enabling the holder to be displaced relative to at least one of the substrate and the removable device, and at least a surface of the holder facing one of the substrate and the removable device is made up of a resin material having slidability.

* * * * *